United States Patent [19]

Waki et al.

[11] 4,308,336

[45] Dec. 29, 1981

[54] COLOR PHOTOGRAPHIC SENSITIVE MATERIALS

[75] Inventors: Kokichi Waki; Keiichi Adachi; Seiki Sakanoue, all of Minami-ashigara, Japan

[73] Assignee: Fuji Photo Film Co., Ltd., Kanagawa, Japan

[21] Appl. No.: 183,471

[22] Filed: Sep. 2, 1980

Related U.S. Application Data

[63] Continuation-in-part of Ser. No. 88,922, Oct. 29, 1979, abandoned.

[30] Foreign Application Priority Data

Oct. 30, 1978 [JP] Japan ..... 53-134051

[51] Int. Cl.[3] ..... G03C 5/54

[52] U.S. Cl. ..... 430/219; 430/223; 430/242; 430/378; 430/382; 430/390; 430/505; 430/544; 430/559; 430/957

[58] Field of Search ..... 430/219, 223, 217, 240, 430/242, 378, 382, 544, 559, 505, 957, 390

[56] References Cited

U.S. PATENT DOCUMENTS

| | | | |
|---|---|---|---|
| 3,352,672 | 11/1967 | Hoppe | 430/219 |
| 3,364,022 | 1/1968 | Barr | 430/219 |
| 3,379,529 | 4/1968 | Porter et al. | 430/566 |
| 3,961,963 | 6/1976 | Shiba et al. | 430/957 |
| 4,053,312 | 10/1977 | Fleckenstein | 430/223 |
| 4,055,428 | 10/1977 | Koyama et al. | 430/223 |
| 4,105,452 | 8/1978 | Shiba et al. | 430/959 |
| 4,135,929 | 1/1979 | Fernandez et al. | 430/223 |
| 4,142,891 | 3/1979 | Baigrie et al. | 430/223 |
| 4,144,071 | 3/1979 | Shiba et al. | 430/382 |
| 4,149,892 | 4/1979 | Deguchi et al. | 430/223 |
| 4,198,235 | 4/1980 | Vetter et al. | 430/223 |

OTHER PUBLICATIONS

"Photo. Processes and Products" *Research Disclosure* No. 15162, 11/76 pp. 76–87.

*Primary Examiner*—J. Travis Brown
*Attorney, Agent, or Firm*—Sughrue, Mion, Zinn, Macpeak & Seas

[57] ABSTRACT

In color photographic sensitive materials comprising at least one direct reversal silver halide emulsion layer associated with a diffusible dye-releasing redox compound on a base, the improvement which comprises that at least one of a layer containing said redox compound or said direct reversal silver halide emulsion layer contains about 5 to 200 mg per 100 millimols silver in the emulsion layer of a compound represented by the general formula (I):

(I)

wherein $A_1$ and $A_2$ each represents a hydrogen atom or a hydrolyzable group, P, Q and R which may be the same or different each represents a hydrogen atom, an alkyl group, an aryl group, an alkylthio group, an arylthio group, a hydroxyl group, a halogen atom, an alkoxy group, an aryloxy group, a heterocyclic group or an —S—$Z^2$ group, $Z^1$ and $Z^2$ may be the same or different and each represents an unsaturated heterocyclic residue which is photographically inactive when bonded to the hydroquinone through the sulfur moiety, and —S—$Z^1$ or —S—$Z^2$ is an atomic group which when released by oxidation exhibits a development inhibiting function; at least one of P and Q is an alkylthio group or an arylthio group, and at least one of P, Q and R contains a ballast group.

35 Claims, No Drawings

COLOR PHOTOGRAPHIC SENSITIVE MATERIALS

CROSS REFERENCE TO RELATED APPLICATION

This application is a continuation-in-part of U.S. Application Ser. No. 88,922 filed Oct. 29, 1979, now abandoned.

BACKGROUND OF THE INVENTION

1. Field of the Invention

The present invention relates to color photographic materials. More particularly, it relates to color photographic materials, which form images having a high maximum density, a low minimum density and improved gradation, and to a process for forming color images using such color photographic materials.

2. Description of the Prior Art

As the direct reversal emulsions, inner latent image type emulsions and solarization type emulsions have been generally known. The inner latent image type direct reversal emulsions have been described in U.S. Pat. Nos. 2,497,875, 2,588,982, 2,456,953, 3,761,276, 3,206,313, 3,317,322, 3,761,266, 3,850,637, 3,923,513, 3,736,140, 3,761,267 and 3,854,949, etc. The solarization type direct reversal emulsions have been described in *The Theory of the Photographic Processes,* pp. 261 to 297, edited by Mees (Macmillan Co., New York, 1942), and processes for preparing them have been described in British Pat. Nos. 443,245 and 462,730 and U.S. Pat. Nos. 2,005,837, 2,541,472, 3,367,778, 3,501,305, 3,501,306 and 3,501,307, etc.

Diffusible dye releasing redox compounds, namely, dye image forming substances which are originally non-diffusible and release a diffusible dye upon decomposition as a result of a reaction such as (1) hydrolysis and ring formation or (2) oxidation and hydrolysis (referred to as "DRR compounds") have been described in, for example, U.S. Pat. Nos. 3,932,381, 3,928,312, 3,931,144, 3,954,476, 3,929,760, 3,942,987, 3,932,380, 4,013,635 and 4,013,633, Japanese Patent Application (OPI) Nos. 113624/76 (The term "OPI" as used herein refers to a "published unexamined Japanese patent application"), 109928/76, 104343/76, 4819/77 and 149328/78 and *Research Disclosure,* pp. 68 to 74 (November, 1976) and the same journal No. 13024 (1975), etc.

It has been well known that an increase in minimum density occurs when a color diffusion transfer photographic material comprising a combination of the above-described direct reversal emulsion and DRR compound is developed using a black-and-white developing agent such as 3-pyrazolidinone derivatives. Alkyl hydroquinones have been used to decrease the minimum density as described in, for example, British Pat. Nos. 558, 258, 557, 750 (corresponding to U.S. Pat. No. 2,360,290), British Pat. Nos. 557,802 and 731,301 (corresponding to U.S. Pat. No. 2,701,197), U.S. Pat. Nos. 2,336,327, 2,403,721 and 3,582,333, German Patent Application (OLS) No. 2,505,016 (corresponding to Japanese Patent Application (OPI) No. 110337/75) and Japanese Patent Application (OPI) No. 4819/77. Similarly, U.S. Pat. No. 3,352,672 reports the use of 5-substituted tetrazoles and U.S. Pat. No. 3,637,387 reports the use of compounds releasing halogen ions to reduce minimum density.

In addition to the above, other techniques and compounds have been relied upon in the art to reduce the minimum density and obtain images of good gradation. In German Patent Application No. 2,427,183 and Japanese Patent Application (OPI) Nos. 8828/77 and 148122/77, it has been described to use compounds which release a development inhibitor by alkali hydrolysis. In *Research Disclosure,* No. 16631 (February, 1978), it has been described to use quinones. In German Patent Application No. 2,746,259, it has been described to add primary aliphatic amino acids or aliphatic acids and primary aliphatic amines to a developing solution. However, in the above-described processes, the minimum density is not sufficiently decreased or the maximum density is simultaneously decreased with the decrease in minimum density. Further, in some cases, the compounds themselves color and stain which increases minimum density.

In *Research Disclosure,* No. 15162 (November, 1976), hydroquinone compounds as disclosed in U.S. Pat. No. 3,379,529 issued to Porter et al which release a development inhibitor (referred to as DIR hydroquinone compounds) have been described for use in photographic materials for the color diffusion transfer process. The embodiments of this invention, however, can be contrasted with the *Research Disclosure* in the following regard. Namely, in this invention, the DIR compound having a specific structural formula indicated hereinafter is used in combination with DRR compounds in a specific location relationship. When such a DIR compound is employed in a specific location relationship, the effect of the invention (e.g., high maximum density, low minimum density and good gradation) can be obtained.

SUMMARY OF THE INVENTION

An object of this invention is to provide color photographic sensitive materials (particularly for the color diffusion transfer process) which provide images having a high Dmax (particularly when processed at low temperatures) and a low Dmin.

Another object of this invention is to provide color photographic sensitive materials (particularly for the color diffusion transfer process) which provide images having good gradation. Here "good gradation" means that the characteristic curve shows good straightness and has good "cut" at the foot part.

A further object of this invention is to provide color photographic sensitive materials (particularly for the color diffusion transfer process) which provide less stain especially in multiple-layered color photographic materials and thus provide images having good color reproduction.

A still further object of this invention is to provide a process for forming excellent color images (high Dmax, low Dmin, good gradation and good color reproduction) using such color photographic sensitive materials.

The above-described objects have been attained in color photographic materials (particularly for the color diffusion transfer process) comprising at least one direct reversal silver halide emulsion layer associated with a DRR compound on a base which are developed, preferably, in the presence of 3-pyrazolidinone derivatives, by adding 5 to 2000 mg of a development inhibitor releasing compound (DIR compound) represented by the following general formula (I), based on 100 millimols of silver in the emulsion layer associated with the DRR compound, to at least one of (1) the direct reversal emulsion layer, (2) the DRR compound-containing layer and (3) the direct reversal emulsion layer containing the DRR compound. Indeed it has been well known that so-called "conventional color photographic sensitive materials can contain DIR hydroquinone compounds, but these materials have been used as couplers, and color image-forming agents and the effect of using DIR hydroquinone compounds relates to an increase in granularity of color photographic image.

On the other hand, in the present invention, DRR compounds are used as color image-forming agent and the effect of using DIR compounds is to obtain a color image which has a low minimum density while maintaining a high maximum density, moreover in good gradation. As the color image-forming agents of the present invention, the DRR compound may be contained in the direct reversal emulsion layer or an associated hydrophilic colloid layer. In the former case, it is preferred to temporarily shift the maximum absorption wavelength of the DRR compound to a shorter wavelength so that the sensitivity of the emulsion containing the compound is not interfered with (namely, it returns to the optimum maximum absorption wavelength after the release of the dye moiety).

However, in the photographic sensitive materials in which a direct reversal silver halide emulsion is combined with a DRR compound, it has been found that images having a high maximum density and a low minimum density are obtained in good gradation by adding a certain DIR hydroquinone compound to a specific layer in a specific amount. To obtain such a good result is an unexpected matter.

General formula (I) is:

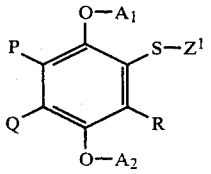

(I)

wherein $A_1$ and $A_2$ each represents a hydrogen atom or a hydrolyzable group, P, Q and R which may be the same or different each represents a hydrogen atom, an alkyl group, an aryl group, an alkylthio group, an arylthio group, a hydroxyl group, a halogen atom, an alkoxy group, an aryloxy group, a heterocyclic group or an —S—$Z^2$ group, $Z^1$ and $Z^2$ may be the same or different and each represents an unsaturated heterocyclic residue which is photographically inactive when bonded to the hydroquinone through the sulfur moiety, and —S—$Z^1$ or —S—$Z^2$ is an atomic group which when released by oxidation exhibits a development inhibiting function; at least one of P and Q is an alkylthio group or an arylthio group, and at least one of P, Q and R contains a ballast group.

DETAILED DESCRIPTION OF THE INVENTION

The above alkyl group, alkylthio group and alkoxy group described for P, Q and R may be substituted or unsubstituted and preferably contain 1 to 20 carbon atoms in the alkyl moiety excluding substituents. Examples of substituents for these groups include alkoxy groups, alkylamino groups, alkylthio groups (in which the alkyl moiety may be straight chain, branched chain or cyclic), carbonamido groups (including an alkylcarbonamido and an arylcarbonamido), sulfonamido groups (including an alkylsulfonamido and an arylsulfonamido), etc., having 1 to about 20 carbon atoms.

The above aryl group, arylthio group and aryloxy group described for P, Q and R may be substituted or unsubstituted. The aryl moieties of these groups may be monocyclic and contain 6 to 20 carbon atoms. Examples of substituents for these groups include alkoxy groups, alkylamino groups, carbonamido groups (including an alkylcarbonamido and an arylcarbonamido), sulfonamido groups (including an alkylsulfonamido and an arylsulfonamido), etc., having 1 to about 20 carbon atoms.

The above-described heterocyclic groups represented by P, Q and R may be unsaturated, condensed, or saturated and contain as hetero atoms one or more of a nitrogen, sulfur or oxygen atom, etc. They are preferably 5-or 6-membered rings containing nitrogen atoms or sulfur atoms as hetero atoms. Representative examples are pyrazole, indazole, triazole, benzotriazole rings, etc. These rings may be substituted by alkyl groups (such as a methyl group, an ethyl group, etc.), an alkoxy group, a carbonamido group (including an alkylcarbonamido and an arylcarbonamido) and a sulfonamido group (including an alkylsulfonamido and an arylsulfonamido).

At least one of P and Q is an alkylthio group or an arylthio group. When the DIR compound having such a specific P and Q substituent is incorporated in a specific layer(s) in relation to the DRR compound, the above described effects are achieved.

The heterocyclic ring represented by $Z^1$ and $Z^2$ is preferably a 5- or 6-membered nitrogen-containing saturated or unsaturated heterocyclic ring. The ring may contain substituents such as an alkyl group (including a substituted alkyl group, for example, a substituted or unsubstituted aminoalkyl group), an alkylthio group, an aryl group (a phenyl group, a substituted phenyl group, for example, an amido-substituted phenyl group, etc.), an amino group (an unsubstituted amino group, a mono- or di-alkyl-substituted amino group, an aryl-substituted amino group, an amino group substituted by an alkyl group and an aryl group). Examples of the heterocyclic group include tetrazolyl groups (for example, a 1-phenyltetrazolyl group, a 1-methyltetrazolyl group, a 3'-acetamido-1-phenyltetrazolyl group, a 1-(2-diethylaminoethyl)tetrazolyl group, etc.), triazolyl groups (for example, a 4-phenyl-1,2,4-triazole-5-yl group, a 3-n-pentyl-4-phenyl-1,2,4-triazole-5-yl group, etc.), thiadiazolyl groups (for example, a 2-methylthio-1,3,4-thiadiazole-5-yl group, a 2-amino-1,3,4-thiadiazole-5-yl group, a 2-thioketo-3-phenyl-1,3,4-thiadiazole-5-yl group, etc.), oxadiazolyl groups (for example, a 2-phenyl-1,3,4-oxadiazole-5-yl group, etc.), tetrazaindenyl groups (for example, a 6-methyl-1,3,3a,7-tetrazaindene-4-yl group, a 6-n-nonyl-1,3,3a,7-tetrazaindene-4-yl group, etc.), oxazolyl groups (for example, a benzoxazole-2-yl group, etc.), thiazolyl groups (for example, a benzothiazole-2-yl group, etc.) and imidazolyl groups (for example, a 1-methylbenzoimidazole-2-yl group, etc.).

At least one of P, Q and R contains a ballast group which renders the compound non-diffusible as a whole. This is of importance for achieving the effects of this invention described above. Examples of the ballast group are the same as those for the DIR compounds illustrated hereafter.

Examples of the compound represented by the general formula (I) are listed below, but this invention is not limited to these.

(1) 2-n-Dodecylthio-5-(1-phenyltetrazole-5-ylthio)-hydroquinone
(2) 2-n-Hexadecylthio-5-(1-phenyltetrazole-5-ylthio)-hydroquinone
(3) 2-n-Octadecylthio-5-(1-phenyltetrazole-5-ylthio)-hydroquinone
(4) 2-n-Dodecylthio-6-(1-phenyltetrazole-5-ylthio)-hydroquinone
(5) 2-n-Hexadecylthio-6-(1-phenyltetrazole-5-ylthio)-hydroquinone
(6) 2-n-Dodecylthio-5,6-bis(1-phenyltetrazole-5-ylthio)hydroquinone
(7) 2-n-Hexadecylthio-5,6-bis(1-phenyltetrazole-5-ylthio)hydroquinone
(8) 2-Phenyltetrazole-5-ylthio)-3-phenylthio-6-(1,1,3,3-tetramethylbutyl)hydroquinone
(9) 2-n-Hexadecylthio-5-(1-phenyltetrazole-5-ylthio)-6-phenylthiohydroquinone
(10) 2-[2,5-Dihydroxy-6-(1-phenyltetrazole-5-ylthio)-3-octadecyl]phenylthiobenzoic acid methyl ester
(11) 2-[2,5-Dihydroxy-6-(1-phenyltetrazole-5-ylthio)-3-hexadecylthio]phenylthiobenzoic acid amyl ester
(12) 2-(3-n-Pentyl-4-phenyl-1,2,4-triazole-5-ylthio)-5-hexadecylthiohydroquinone
(13) 2-n-Decylthio-5-(1-phenyltetrazole-5-ylthio)hydroquinone
(14) 2-n-Decylthio-5-[1-(2-diethylaminoethyl)tetrazole-5-ylthio]hydroquinone
(15) 2-n-Decylthio-5-(2-thioketo-3-phenyl-1,3,5-thiadiazole-5-ylthio)hydroquinone
(16) 2-n-Decylthio-6-(1-phenyltetrazole-5-ylthio)hydroquinone
(17) 2-n-Decylthio-5,6-bis(1-phenyltetrazole-5-ylthio)hydroquinone
(18) 2n-Decylthio-5-(1-phenyltetrazole-5-ylthio)-6-phenylthiohydroquinone Of the above compounds, Compounds (1), (2) and (3) are particularly preferred.

The above DIR hydroquinones can be synthesized in accordance with the manner described in U.S. Pat. No. 3,379,529, British Pat. No. 1,433,450 and R. F. Porter et al., *Journal of Organic Chemistry,* Vol. 29, pp. 588–594 (1964), H. S. Wilgus et al., ibid., pp. 594–600.

The DIR compounds represented by the formula (I) may be used in mixtures of two or more in a suitable ratio, or may be used together with compounds such as described in the above literature.

The compound represented by the formula (I) in the present invention is preferably used in a photographic material in an amount of 20 to 500 mg per 100 millimols of the silver content in the associated silver halide emulsion layer and/or DRR compound containing layer.

The direct reversal emulsions used in the present invention are dispersions of silver chloride, silver bromide, silver chlorobromide, silver iodobromide, silver chloroiodobromide or mixtures thereof in a hydrophilic colloid. Though the halogen composition is selected according to the purpose of the photosensitive materials or the processing condition thereof, it is preferred to use silver bromide, silver iodobromide or silver chloroiodobromide containing 10% by mol or less iodide, 30% by mol or less chloride and the balance of bromide. Silver halide particles may have a conventional particle size or a very fine particle size, but it is preferred that the average particle size (i.e., number average particle size of the diameter of particles by a projected area method) is in a range from about 0.1 micron to about 2 micron. Further, a uniform particle size is desirable. The particles used may have a cubic crystal form, an octahedral crystal form or a mixed crystal form. These silver halide emulsions can be produced according to conventional processes such as that described in *Chimie Photographique,* written by P. Glafkides (2nd Edition, 1957, Paul Montel, Paris) Chapters 18 to 23.

The direct reversal emulsions used in the present invention may be inner latent image type emulsions or solarization type emulsions.

The DRR compound can be present in the silver halide emulsion layer or in an adjacent associated hydrophilic colloid layer (not containing silver halide). From the standpoint of reducing the number of layers, the DRR compounds are preferably located in the silver halide emulsion layer since the number of layers can be reduced. However, in order to incorporate them in the silver halide emulsion layer, it is necessary to temporarily shift the maximum absorption wavelength of the DRR compounds to a shorter wavelength so as not to interfere with the sensitivity of the emulsion. The compound then returns to its optimum maximum absorption wavelength after release of the dye moiety. The DIR compound of the formula (I) can be located in the silver halide emulsion layer with the DRR compound or in adjacent layer with the DRR compound. On the other hand, the DIR compound can be located in the silver halide emulsion layer and the DRR compound can be located in an adjacent layer alone or with additional DIR compound. Of these the DRR and DIR compounds are preferably located together in a layer adjacent the silver halide emulsion layer.

It is preferred that the silver halide emulsions used in the present invention are sensitized by a natural sensitizer contained in gelatin or chemically sensitized by one or more sulfur sensitizers such as N,N-triethylthiourea, gold sensitizers such as thiocyanate complex salts or thiosulfate complex salts of monovalent gold and reducing sensitizers such as stannous chloride or hexamethylentretramine.

A sulfur sensitizer is, for example, a thiosulfate, a thiourea, a thiazole, a rhodanine, etc., such as described in U.S. Pat. Nos. 1,574,944, 2,410,689, 2,278,947, 2,728,668, 3,656,955, 4,030,928, and 4,067,740. The reducing sensitizer is, for example, a stannous salt, an amine, a hydrazine derivative, formamidine-sulfinic acid, silane compounds, etc., such as described in U.S. Pat. Nos. 2,487,850, 2,419,974, 2,518,698, 2,983,609, 2,983,610, 2,694,637, 3,930,867, 4,054,458. Noble metal sensitizers such as a gold sensitizer, for example, a gold complex salt and complex salt containing a metal of Group VIII in the Periodic Table such as platinum, iridium, paradium, etc., such as described in U.S. Pat. Nos. 2,399,083 and 2,448,060, and British Patent 618,061 are also useful.

Photosensitive materials can contain various compounds in order to prevent fog during manufacture, preservation or photographic treatments, or for stabilization. That is, various compounds which are well known as antifoggants, or stabilizers such as azoles (for example, a benzothiazolium salt, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotrazoles (particularly, a 1-phenyl-5-mercaptotetrazole), etc.); mercaptopyridines; mercaptotriazines; thioketo compounds (for example, oxazolinethion); azaindenes (for example, triazaindenes, tetrazaindenes (for example, 4-hydroxy-substituted (1,3,3a,7)tetrazaindenes), pentazaindenes, etc.); benzenethiosulfonic acid, benzenesulfinic acid, benzenesulfonamide, etc., can be used in conjunction with the present invention. For example, the compound described in U.S. Pat. Nos. 3,954,474 and 3,982,947 and Japanese Patent Publication No. 28660/77 can be used.

The silver halide emulsions used in the present invention may be stabilized by conventional stabilizers. Further, the silver halide emulsions used may contain sensitizing compounds such as polyethylene oxide compounds.

The silver halide emulsions used in the present invention may, if necessary, be spectrally sensitized. Useful spectral sensitizers include cyanine, merocyanine, holopolar cyanine, styryl, hemicyanine, oxanole and hemioxanole dyes, etc. Examples of the spectral sensitizers have been described in, for example, *The Cyanine and Related Compounds*, written by P. Glafkides, Chapters 35 to 41 (Interscience). Particularly, cyanines in which the nitrogen atom on the basic heterocyclic nucleus is substituted by an aliphatic group (for example, an alkyl group) having a hydroxyl group, carboxyl group or sulfo group, such as compounds described in U.S. Pat. Nos. 2,503,776, 3,459,553 and 3,177,210 are useful for practicing the present invention.

The DRR compound used in the present invention can be represented by the following formula (II).

$$Y—D \qquad (II)$$

where Y represents a group which releases the diffusible dye D (or precursor thereof) by decomposition of the DRR compound as a result of development and is a so-called "redox center". Generally, Y contains a "ballast group" for making the DRR compound non-diffusible. D may be a dye compound per se or may contain a group linking the dye too Y. Typical examples of such a dye include azo dyes. Examples of suitable D moiety include groups such as an azo dye, an azomethine dye, an indoaniline dye, an indophenol dye, a triphenylmethane dye, an anthraquinone dye, an indigo dye, the metallic complex salt thereof, and further, compounds capable of releasing the above-described dye by hydrolysis, etc., for example, a dye having an acylated auxochrome as described in Japanese Patent Application (OPI) No. 125818/73 and U.S. Pat. Nos. 3,222,196, 3,307,947, etc. The latter compounds are particularly useful in order to temporarily shift absorption of the dye to shorter wavelengths during exposure and thereby prevent the desensitization attributable to the redox compound in the photographic emulsion. To attain the above object, a dye the hue of which is different when it is transferred on mordanted and when it is present in the emulsion layer can be used.

The D moiety may contain a substituent which gives it water solubility such as a carboxyl group, a sulfonamido group, etc.

The preferred dye moiety represented by D is an azo dye moiety represented by the following formula (Da) or (Db):

$$A—N{=}N—B— \qquad (Da)$$

$$—A—N{=}N—B \qquad (Db)$$

wherein A represents a coupling component residue derived from a phenol or a nucleus-substituted phenol, a 1- or 2-naphthol or a nucleus-substituted 1-or 2-naphthol, a pyrazolone or a nucleus-substituted pyrazolone or an acyclic or alicyclic $\beta$-ketone compound; and B represents a phenyl group, a nucleus-substituted phenyl group, a naphthyl group of a nucleus-substituted naphthyl group.

Yellow dye moieties have been described in, for example, U.S. Pat. No. 4,013,633, Japanese Patent Application (OPI) Nos. 7727/77, 149328/78 and 114930/76 and *research Disclosure*, Vol. 176, No. 17630 (1978).

Magenta dye moieties have been described in, for example, U.S. Pat. Nos. 3,954,476, 3,931,144 and 3,932,308, German Patent Application (OLS) No. 2,847,371, Japanese Patent Application (OPI) Nos. 23628/78, 106727/77 and 65034/79 and Japanese Patent Application Nos. 69488/78 (OPI 161332/79), 76162/78 (OPI 4028/80), 96445/78 (OPI 36804/80), 42848/79 (OPI 134850/80) and 96449/78 (OPI 40402/80).

Cyan dye moieties have been described in, for example, U.S. Pat. Nos. 3,942,987, 3,929,760, and 4,013,635, Japanese Patenet Application (OPI) Nos. 149328/78, 8827/77, 47823/78 and 143323/78.

Y may be a group represented by the formula (A):

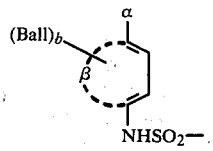

(A)

In the above formula, $\beta$ represents the non-metallic atomic group necessary to complete a benzene ring to which a 5- or 6-membered saturated or unsaturated aromatic carbocyclic or saturated or unsaturated aromatic heterocyclic ring may be fused to form, for example, a naphthalene ring, a quinoline ring, a 5,6,7,8-tetrahydronaphthalene ring, a chroman ring, etc. for, the above-described benzene ring or the fused carbocyclic or heterocyclic ring may be substituted with substituents such as a halogen atom, an alkyl group having 1 to 8 carbon atoms and preferably 1 to 4 carbon atoms, an alkoxy group having 1 to 8 carbon atoms and preferably 1 to 4 carbon atoms, an aryl group having 6 to 12 carbon atoms and preferably 6 to 9 carbon atoms, an aryloxy group having 6 to 12 carbon atoms and preferably 6 to 9 carbon atoms, a nitro group, an amino group, an alkylamino group having 1 to 8 carbon atoms and preferably 1 to 4 carbon atoms, an arylamino group having 6 to 12 carbon atoms and preferably 6 to 9 carbon atoms, an amido group, a cyano group, an alkylmercapto group having 1 to 8 carbon atoms and preferably 1 to 4 carbon atoms, a keto group, a carboalkoxy group having 2 to 10 carbon atoms and preferably 2 to 6 carbon atoms, a heterocyclic ring and preferably a 5- or 6-membered heterocyclic ring having N, O and S as a hetero atom, etc., wherein the alkyl moieties of the aforesaid substituents may be straight chain, branched chain or cyclic and the aryl moieties may be mono- or bicyclic.

$\alpha$ represents an $—OG^1$ or $—NHG^2$ group, wherein $G^1$ represents a hydrogen atom or a group capable of forming a hydroxyl group upon hydrolysis, and it preferably represents a hydrogen atom or a group represented by a $$-\overset{O}{\overset{\|}{C}}G^3$$

group or a $$-\overset{O}{\overset{\|}{C}}-O-G^3$$

group wherein $G^3$ represents an alkyl group, in particular, a straight, branched or cyclic alkyl group having 1 to 18 carbon atoms (e.g., a methyl group, an ethyl group, a propyl group, etc.), a halogen-substituted straight, branched or cyclic alkyl group having 1 to 18 carbon atoms (e.g., a chloromethyl group, a trifluoromethyl group, etc.), a phenyl group or a substituted phenyl group, a $G^2$ represents a hydrogen atom, a straight, branched or cyclic alkyl group having 1 to 22 carbon atoms or a hydrolyzable group (i.e., a group capable of forming an amino group by hydrolysis). Representative examples of suitable substituents for the phenyl group include a cyano group, a $C_1$-$C_4$ alkylsulfonyl group, a nitro group, a halogen atom such as a chlorine atom, a $C_1$-$C_4$ alkyl group, an acetamido group, a $C_1$-$C_4$ alkoxy group, etc. Preferred examples of the hydrolyzable group represented by $G^2$ are $$-\overset{O}{\overset{\|}{C}}G^4,\ -SO_2G^5 \text{ or } -SOG^5,$$

wherein $G^4$ represents a straight, branched or cyclic alkyl group having 1 to 8 and preferably 1 to 4 carbon atoms (e.g., a methyl group); a halogen-substituted straight, branched or cyclic alkyl group having 1 to 8 and preferably 1 to 4 carbon atoms (e.g., mono-, di- or trichloromethyl group or a trifluoromethyl group); an alkylcarbonyl group wherein alkyl moiety is a straight chain, branched chain or cyclic alkyl group having 1 to 8 and preferably 1 to 4 carbon atoms (e.g., methylcarbonyl, ethylcarbonyl, propylcarbonyl, isopropylcarbonyl, butylcarbonyl, t-butylcarbonyl, etc.); a straight chain, branched chain or cyclic alkoxy group having 1 to 7 and preferably 1 to 4 carbon atoms (e.g., methoxy, ethoxy, propoxy, butoxy, etc.); a substituted phenyl group (e.g., a nitrophenyl group or a cyanophenyl group); a phenyloxy group unsubstituted or substituted by a $C_1$-$C_5$ alkyl group or a halogen atom; a carbonyl group; straight chain, branched chain or cyclic alkoxycarbonyl group having 2 to 9 and preferably 2 to 5 carbon atoms (e.g., methoxycarbonyl, ethoxycarbonyl, propoxycarbonyl, butoxycarbonyl, etc.); an aryloxycarbonyl group wherein the aryl moiety is monocyclic or bicyclic aryloxy group having 6 to 12 and preferably 6 to 9 carbon atoms (e.g., phenoxycarbonyl, p-methoxyphenoxycarbonyl, etc.); an alkylsulfonylethoxy group wherein alkyl moiety is straight chain, branched chain or cyclic alkyl group having 1 to 8 and preferably 1 to 4 carbon atoms; an arylsulfonylethoxy group wherein aryl moiety is monocyclic or bicyclic aryl group having 6 to 12 and preferably 6 to 9 carbon atoms, and $G^5$ represents a substituted or unsubstituted alkyl or aryl group where the alkyl group has 1 to 8 and preferably 1 to 4 carbon atoms wherein alkyl group may be straight chain, branched chain or cyclic and may be substituted by, for example, halogen, alkoxy, etc.; and the aryl group has 6 to 12 and preferably 6 to 9 carbon atoms wherein aryl group may be monocyclic or bicyclic and may be substituted by nitro, cyano, alkyl, alkoxy, halogen, etc.

Further, b represents 1 or 2, preferably 1, when $\alpha$ represents a group represented by $-OG^1$ or $-NHG^2$ wherein $G^2$ represents a hydrogen atom, an alkyl group having 1 to 8 carbon atoms or a hydrolyzable group. b represents 0 or 1 when $\alpha$ represents $-NHG^2$ wherein $G^2$ represents an alkyl group having about 9 to 22 carbon atoms and making the compound of the general formula (A) immobile and non-diffusible. Ball represents a ballast group which will be described in detail hereinafter.

Specific examples of this Y and DRR compound are described in U.S. Tupp No. B 351,673, U.S. Pat. Nos. 4,076,529, 3,928,312, 4,135,929 and 3,993,638.

Another example of Y is a group represented by the following formula (B):

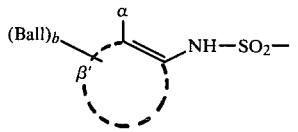

(B)

In the above formula, Ball $\alpha$ and b are each the same meaning as defined in formula (A), $\beta'$ represents the atomic group necessary to form a benzene ring to which a carbocyclic or a heterocyclic saturated, unsaturated or aromatic ring may further be fused to form a naphthalene ring, a quinoline ring, a 5,6,7,8-tetrahydronaphthalene ring, a chroman ring, etc. The above-described various rings may be further substituted by a halogen atom, an alkyl group having 1 to 8 and preferably 1 to 4 carbon atoms which may be straight chain, branched chain or cyclic; an alkoxy group having 1 to 8 and preferably 1 to 4 carbon atoms which may be straight chain, branched chain or cyclic; an aryl group having 6 to 12 and preferably 6 to 9 carbon atoms which may be monocyclic or bicyclic; an aryloxy group having 6 to 12 and preferably 6 to 9 carbon atoms which may be monocyclic or bicyclic; a nitro group; an amino group; an alkylamino group in which the alkyl moiety has 1 to 8 and preferably 1 to 4 carbon atoms and is straight, branched or cyclic; an arylamino group in which the aryl moiety has 6 to 12 and preferably 6 to 9 carbon atoms and is monocyclic or bicyclic; an amido group; a cyano group; an alkylmercapto group in which the alkyl moiety has 1 to 8 and preferably 1 to 4 carbon atoms and is straight, branched or cyclic; a keto group; a carboalkoxy group having 2 to 9 and preferably 2 to 5 carbon atoms and which is straight, branched or cyclic; a 5- or 6-membered heterocyclic ring where the heteroatom(s) may be any of O, S or N, or the like. Specific examples of this type Y are described in U.S. Pat. Nos. 4,053,312 and 4,055,428, Japanese Patent Application Nos. 89128/79 (OPI 12642/81) and 90806/79 (OPI 16130/81), and U.S. Patent Application Ser. No. 170,261 filed July 18, 1980.

A further example of Y is a group represented by the general formula (C):

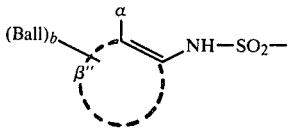

(C)

In the above formula, Ball, $\alpha$ and b are the same as defined in the formula (A), and $\beta''$ represents the atomic group necessary to form a 5- or 6-membered saturated or unsaturated N-containing heterocyclic ring such as a pyrazole ring, a pyridine ring, etc., to which a carbocyclic ring or an N, S or O-containing heterocyclic ring may further be fused. The above-described rings may be substituted by the same substituents as those for the rings described in the formula (B). Specific examples of this type Y are described in U.S. Pat. No. 4,198,235 and Belgian Pat. No. 838,062.

A still further example of Y is illustrated by the formula (D):

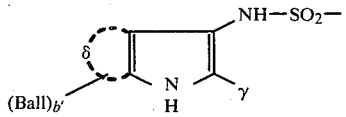

(D)

In the above formula, $\gamma$ preferably represents a hydrogen atom, a $C_1$–$C_{22}$ straight, branched or cyclic alkyl group, a $C_6$–$C_{24}$ mono- or bicyclic aryl group or an N, S or O-containing 5- or 6-membered heterocyclic ring which may be unsubstituted or substituted (Examples of the substituent for the alkyl group include alkoxy, phenoxy, etc. Examples of the substituent for the aryl group include alkoxy, alkyl, nitro, halogen, cyano, etc.); or a —CO—$G^6$ group wherein $G^6$ represents

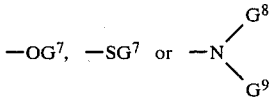

and $G^7$ represents a hydrogen atom, a straight chain, branched chain or cyclic alkyl group having 1 to 22 carbon atoms wherein said alkyl group may be unsubstituted or substituted and examples of the substituent include alkoxy, phenoxy, etc.; or an aryl group having 6 to 24 carbon atoms and which may be monocyclic or bicyclic and substituted or unsubstituted and which may be substituted, for example, by an alkoxy group, an alkyl group, a nitro group, a halogen atom, a cyano group, etc.; $G^8$ has the same definition as $G^7$ or may be an acyl group derived from a $C_2$–$C_{22}$ aliphatic or a $C_7$–$C_{23}$ aromatic carboxylic acid or from a sulfonic acid, and $G^9$ represents a hydrogen atom or a substituted or unsubstituted alkyl group where the alkyl group may contain 1 to 22 carbon atoms and be straight, branched or cyclic and may be substituted by, for example, a $C_1$–$C_{20}$ alkoxy group, a phenoxy group, a cyano group, a halogen atom, etc; $\delta$ represents a residue necessary to complete a fused benzene ring which ring may have one or more substituents. Ball is the same as defined in the formula (A). b' represents 0 or 1 when $\gamma$ represents an above-mentioned group having more than 8 carbon atoms. b' represents 1 or 2 when $\gamma$ represents an above-mentioned group having 1 to 8 carbon atoms. Substituents for the ring $\delta$ may be the same as defined for the rings in formulae (A) and (B), e.g., an alkoxy group, an alkyl group, a halogen atom, etc. Specific examples of this type Y are described in U.S. Pat. No. 4,198,235 and Japanese patent application (OPI) No. 46730/78.

Still a further example of Y is a group represented by the formula (E):

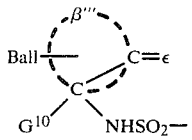

(E)

In the above formula, Ball is the same as defined in the formula (A), $\epsilon$ represents an oxygen atom or an =NG'' group where G'' represents a hydroxyl group or an amino group which may be substituted as described below. The group =NG'' is derived from a carbonyl reagent of $H_2N$—G''. Examples of the compound of $H_2N$—G'' are hydroxylamines, hydrazines, semicarbazides, thiosemicarbazides, etc. The hydrazines represented by $H_2N$—G'' are, for example, hydrazine, phenylhydrazine, substituted phenylhydrazine having in the phenyl moiety a substituent or substituents such as a straight, branched or cyclic alkyl group having 1 to 8 and preferably 1 to 4 carbon atoms, a straight, branched or cyclic alkoxy group having 1 to 8 and preferably 1 to 4 carbon atoms, a carboalkoxy group having 2 to 9 and preferably 2 to 5 carbon atoms, a halogen atom (e.g., Cl, Br, F), etc., isonicotinic acid hydrazine, etc. As the semicarbazides represented by $H_2N$—G'' there are illustrated phenylsemicarbazide or substituted phenylsemicarbazide substituted by a $C_1$–$C_8$ and preferably $C_1$–$C_4$ alkyl group, a $C_1$–$C_8$ and preferably $C_1$–$C_4$ alkoxy group, a $C_2$–$C_9$ and preferably $C_2$–$C_5$ carboalkoxy group, a halogen atom (e.g., Cl, Br, F), etc. As the thiosemicarbazides represented by $H_2N$—G'' there are illustrated the same derivatives as with semicarbazides.

$\beta'''$ in the formula represents a 5-, 6- or 7-membered saturated or unsaturated non-aromatic carbocyclic ring. To be specific, there are illustrated, for example, cyclopentanone, cyclohexanone, cyclohexenone, cyclopentenone, cycloheptanone, cycloheptenone, etc. These 5- to 7-membered non-aromatic carbocyclic rings may be fused to other rings at a suitable position to form a fused ring system. As the other ring, various 5- or 6-membered rings may be used regardless of whether they show aromaticity or not or whether they are carbocyclic or heterocyclic rings. However, in the case of a fused ring being formed, fused systems wherein benzene and the above-described 5- 7-membered non-aromatic hydrocarbon ring are fused to each other such as indanone, benzcyclohexenone, benzcycloheptenone, etc., are preferred in the present invention.

The above-described 5- to 7-membered non-aromatic carbocyclic rings or the above-described fused rings may be substituted by one or more of a $C_1$–$C_8$ and preferably $C_1$–$C_4$ alkyl group, a $C_6$–$C_{12}$ and preferably $C_6$–$C_9$ aryl group, a $C_1$–$C_8$ and preferably $C_1$–$C_4$ alkoxy group, a $C_6$–$C_{12}$ and preferably $C_6$–$C_9$ aryloxy group, a $C_2$–$C_9$ and preferably $C_2$–$C_5$ alkylcarbonyl group, a $C_7$–$C_{13}$ and preferably $C_7$–$C_{10}$ arylcarbonyl group, a $C_1$–$C_8$ and preferably $C_1$–$C_4$ alkylsulfonyl group, a $C_6$–$C_{12}$ and preferably $C_6$–$C_9$ arylsulfonyl group, a $C_1$–$C_8$ and preferably $C_1$–$C_4$ alkylamino group, a $C_6$–$C_{12}$ and preferably $C_6$–$C_9$ arylamino group, a $C_2$–$C_9$ and preferably $C_2$–$C_5$ alkylamido group, a $C_7$–$C_{13}$ and preferably $C_7$–$C_{10}$ arylamido group, a $C_1$–$C_8$ and preferably $C_1$–$C_4$ alkylmercapto group, a $C_2$–$C_9$ and preferably $C_2$–$C_5$ alkoxycarbonyl group, a halogen atom (e.g., F, Cl, Br), a nitro group, an amino group, a cyano group, an amido group, etc.

$G^{10}$ represents a hydrogen atom, or a halogen atom such as fluorine, chlorine or bromine.

Specific examples of this Y and DRR compound are described in U.S. Pat. No. 4,149,892.

Still further examples of Y are described in, for example, Japanese Patent Publication Nos. 32129/73 and 39165/73, Japanese Patent Application (OPI) No. 64436/74 and U.S. Pat. No. 3,443,943, etc.

The compounds represented by the formula (II) may be non-diffusible dye image-forming compounds which release a diffusible dye under alkaline conditions through self cyclization or the like but, when reacted with the oxidation product of a developing agent, do not substantially release the dye. As an example of Y effective for this type compound, there is a group represented by the formula (F):

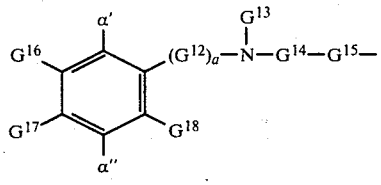

(F)

Wherein $\alpha'$ represents an oxidizable nucleophilic group such as a hydroxyl group, a primary or secondary amino group, a hydroxyamino group or a sulfonamido group, or a precursor thereof

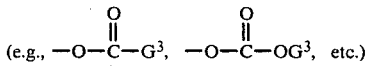

and preferably represents a hydroxyl group.

$\alpha''$ represents a $C_1$–$C_{22}$ dialkylamino group or any of those groups defined for $\alpha'$, preferably a hydroxyl group. $G^{14}$ represents an electrophilic group such as —CO—, —CS—, etc., preferably —CO—. $G^{15}$ represents an oxygen atom, a sulfur atom, a selenium atom, a nitrogen atom, etc., and when $G^{15}$ represents a nitrogen atom it may be substituted by a hydrogen atom, an unsubstituted or substituted alkyl group having 1 to 10 carbon atoms, or an aryl group having 6 to 20 carbon atoms. Preferably $G^{15}$ is an oxygen atom. $G^{12}$ represents an alkylene group containing 1 to 3 carbon atoms, and a represents 0 or 1, preferably 0. $G^{13}$ is a substituted or unsubstituted straight, branched or cyclic alkyl group containing 1 to 40 carbon atoms or a substituted or unsubstituted mono- or bicyclic aryl group containing 6 to 40 carbon atoms, preferably an alkyl group. $G^{16}$, $G^{17}$ and $G^{18}$ each represents a hydrogen atom, a halogen atom, a carbonyl group, a sulfamyl group, a sulfonamido group, a straight, branched or cyclic alkyloxy group containing 1 to 40 carbon atoms, or may be the same as defined for $G^{13}$ or, when taken together, $G^{16}$ and $G^{17}$ may form a 5- or 7-membered saturated, unsaturated or aromatic ring. Also, $G^{17}$ may be

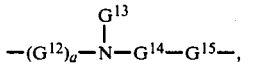

provided that at least one of $G^{13}$, $G^{16}$, $G^{17}$ and $G^{18}$ represents a ballast group.

Specific examples of this type Y are described in Japanese Patent Application (OPI) No. 63618/76.

Another example of Y is illustrated by the formula (G):

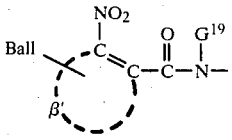

(G)

wherein Ball and $\beta'$ are the same as defined in the formula (B), and $G^{19}$ represents a $C_1$–$C_4$ straight or branched alkyl group (including a substituted alkyl group). Specific examples of this type Y are described in Japanese Patent Application (OPI) No. 35533/78.

As a further example of Y there is further illustrated a group represented by the formula (H):

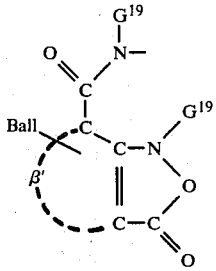

(H)

wherein Ball and $\beta'$ are the same as defined in the formula (B), and $G^{19}$ is the same as defined in the formula (G). Specific examples of this Y and DRR compound are described in Japanese Patent Application (OPI) Nos. 111628/74 and 4819/77 and British Pat. No. 1,542,308.

Of the above-described compounds, particularly preferred are dye-releasing redox compounds in which Y is an N-substituted sulfamoyl group. As the N-substituents for the N-substituted sulfamoyl groups, carbocyclic ring groups or heterocyclic ring groups are desirable. As examples of N-carbocyclic ring substituted sulfamoyl groups, those represented by formula (A) and (B) are particularly preferred. As examples of N-heterocyclic ring substituted sulfamoyl groups, those represented by formulae (C) and (D) are particularly preferred.

As Y, the group represented by the formula (IIa) is particularly preferred.

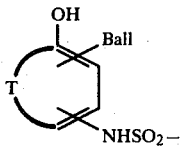

(IIa)

wherein Ball represents a ballast group; T represents an atomic group necessary to complete a benzene ring including a substituted benzene ring or a naphthalene ring including a substituted naphthalene ring; the —$NHSO_2$— group is present at the o- or p-position to the hydroxy group; and when T represents the atoms necessary to complete a naphthalene ring, Ball can be bonded to either of the two rings.

Thus, the group represented by the formula (II-b) is most preferred as Y.

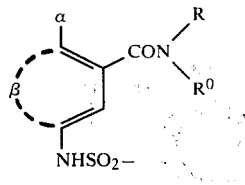

(II-b)

wherein $\beta$ represents the non-metallic atoms necessary to complete a naphthalene ring which may be substituted;

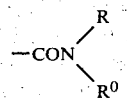

is a ballast group wherein R and $R^0$, which may be the same or different each represents an alkyl group; $\alpha$ represents an —$OG^1$ or —$NHG^2$ group where $G^1$ represents a hydrogen atom or a group which forms a hydroxyl group upon hydrolysis, and $G^2$ represents a hydrogen atom, a hydrolyzable group or an alkyl group having 1 to 22 carbon atoms, Ball represents a ballast group and b is 0, 1 or 2.

Examples of suitable substituents which can be present on the benzene ring or the naphthalene ring include a straight, branched or cyclic alkyl group (preferably an alkyl group having 1 to 7 carbon atoms, particularly 1 to 4 carbon atoms), a halogen atom (such as a chlorine atom, etc.), etc., or a 5-, 6- or 7-membered heterocyclic ring (where the hetero atoms are O, S or N) or a non-aromatic 5-, 6- or 7-membered carbocyclic ring fused to the benzene ring. These rings may be further substituted.

The ballast group is an organic ballast group capable of rendering the dye image-forming compound nondiffusible during development in an alkaline processing solution and preferably contains a hydrophobic residue having 8 to 32 carbon atoms. This organic ballast group can be bonded to the dye image-forming compound directly or through a linking group, for example, an imino bond, an ether bond, a thioether bond, a carbonamido bond, a sulfonamido bond, a ureido bond, an ester bond, an imido bond, a carbamoyl bond, a sulfamoyl bond, etc., alone or in combination thereof.

Specific examples of ballast groups are illustrated below.

An alkyl group or an alkenyl group (for example, a dodecyl group, a hexadecyl group, an octadecyl group, etc.), an alkoxyalkyl group (for example, a 3-(octyloxy)-propyl group, a 3-(2-ethylundecyloxy)propyl group, etc., as described in Japanese Patent Publication No. 27563/64, etc.), an alkylaryl group (for example, a 4-nonylphenyl group, a 2,4-di-tert-butylphenyl group, etc.), an alkylaryloxyalkyl group (for example, a 2,4-di-tert-pentylphenoxymethyl group, a 2,4-di-tert-pentylphenoxyethyl group, an $\alpha$-(2,4-di-tert-pentylphenoxy)-propyl group, a 1-(3-pentadecylphenoxy)ethyl group, etc.), an acylamidoalkyl group (for example, a group described in U.S. Pat. Nos. 3,337,344 and 3,418,129, a 2-(N-butylhexadecanamido)ethyl group, etc.), an alkoxyaryl or an aryloxyaryl group (for example, a 4-(n-octadecyloxy)phenyl group, a 4-(4-n-dodecylphenyloxy)phenyl group, etc.), a residue containing both an alkyl or alkenyl long-chain aliphatic group and a water-solubilizing group such as a carboxy group or a sulfo group (for example, a 1-carboxymethyl-2-nonadecenyl group, a 1-sulfoheptadecyl group, etc.), an alkyl group substituted with an ester group (for example, a 1-ethoxycarbonylheptadecyl group, a 2-(n-dodecyloxycarbonyl)ethyl group, etc.), an alkyl group substituted with an aryl group or a heterocyclic group (for example, a 2-[4-(3-methoxycarbonyluneicosanamido)phenyl]ethyl group, a 2-[4-(2-n-octadecylsuccinimido)phenyl]ethyl group, etc.), and an aryl group substituted with an aryloxyalkoxycarbonyl group (for example, a 4-[2-(2,4-di-tert-pentylphenoxy)-2-methylpropyloxycarbonyl]phenyl group, etc.).

Of the above-described organic ballast groups, those bonded to a bridging group as represented by the following general formuale are particularly preferred.

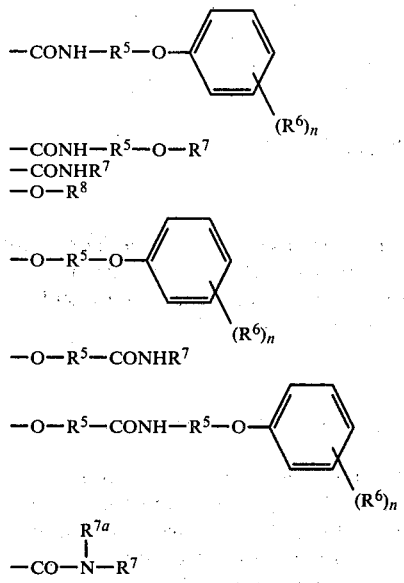

wherein $R^5$ represents an alkylene group having 1 to 10 carbon atoms, preferably 1 to 6 carbon atoms (such as a propylene group, a butylene group, etc.); $R^6$ represents a hydrogen atom or an alkyl group having 1 to 10 carbon atoms, preferably 1 to 6 carbon atoms (such as a tert-amyl group, etc.); n represents an integer of 1 to 5 (preferably 1 to 2); $R^7$ represents an alkyl group having 4 to 30 carbon atoms, preferably 10 to 20 carbon atoms (such as a dodecyl group, a tetradecyl group, a hexadecyl group, etc.); and $R^8$ represents an alkyl group having 8 to 30 carbon atoms, preferably 10 to 20 carbon atoms (such as a hexadecyl group, an octadecyl group, etc.); $R^{7a}$ represents an alkyl group having 1 to 30 carbon atoms, preferably 1 to 20 carbon atoms, or a substituted alkyl group having 1 to 30 and preferably 1 to 20 carbon atoms in which the alkyl moiety has one or more carbon atoms, with examples of suitable substituents being one or more of, for example, a carbamoyl group, a cyano group, a halogen atom, etc.

Specific examples of sulfamoyl groups represented by the formula (II) are illustrated below.

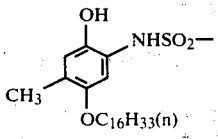

-continued
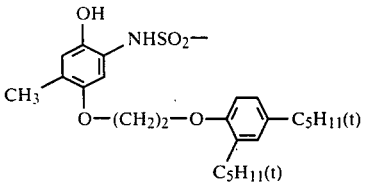
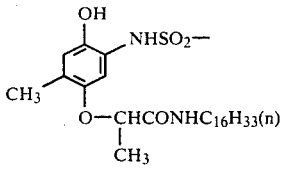
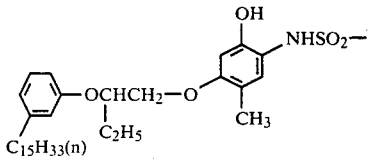
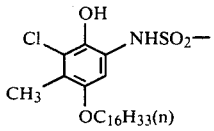
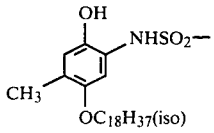
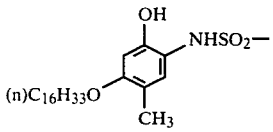
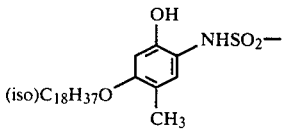
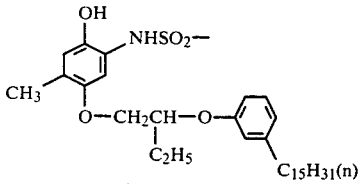
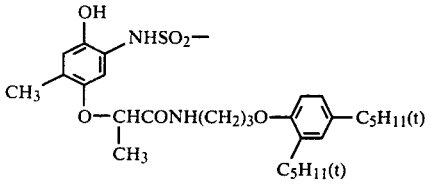
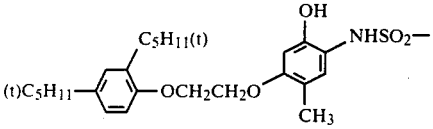
-continued
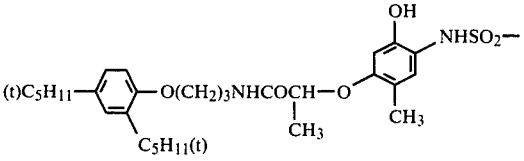
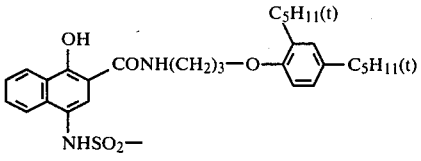
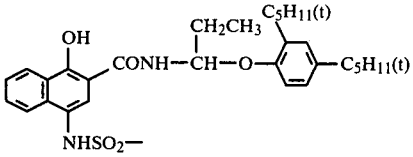
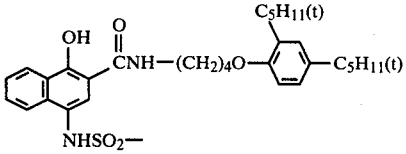
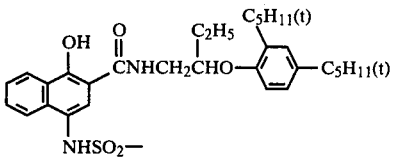
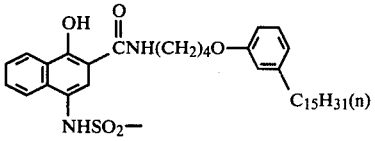
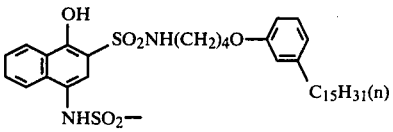
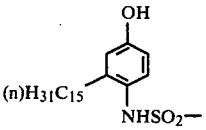
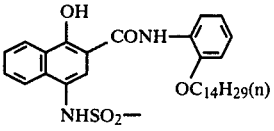
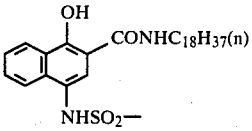

-continued

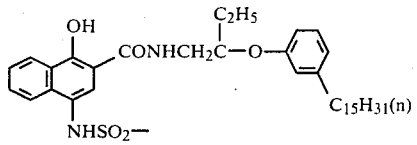

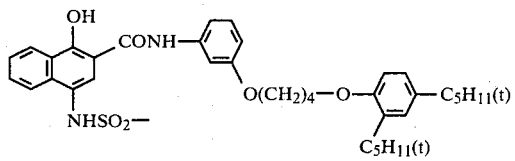

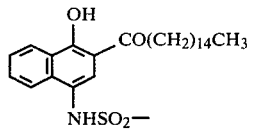

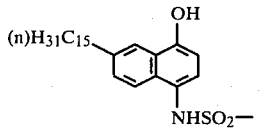

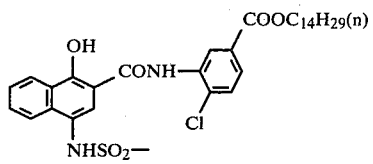

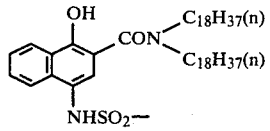

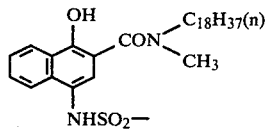

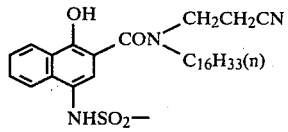

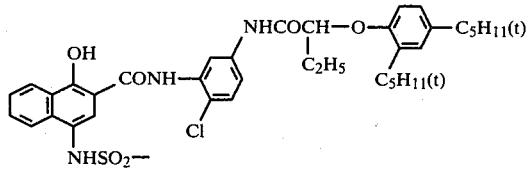

Furthermore, the groups described in *Research Disclosure,* Vol. 130, No. 13024 (February, 1975) are useful for Y.

As the DRR compound used in the present invention in addition to those described in the above-described patent specifications, there are 1-hydroxy-2-tetramethylenesulfamoyl-4-[3'-methyl-4'-(2''-hydroxy-4''-methyl-5''-hexadecyloxyphenylsulfamoyl)phenylazo]naphthalene compounds which are magenta dye image-forming substances, and 1-phenyl-3-cyano-4-{3'-[2''-hydroxy-4''-methyl-5''-(2''',4'''-di-t-pentylphenoxyacetamino)phenylsulfamoyl]phenylazo}pyrazolone which are yellow dye image-forming substances. In addition, the DRR compounds described in the following publications can be used in the present invention: U.S. Patent Application TVPP No. B 351,673, U.S. Pat. Nos. 4,076,529, 3,928,312, 4,135,929, 3,993,638, 4,053,312, 4,055,428, 4,149,892, 3,443,943, 4,013,633, 3,954,476, 3,931,144, 3,932,308, 3,942,987, 3,929,760 and 4,013,635, Japanese Patent Application (OPI) Nos. 104343/76, 46730/78, 64436/74, 63618/76, 35533/78, 111628/74, 4819/77, 7727/77, 149328/78, 114930/76, 23628/78, 106727/77, 65034/79, 143323/78, 8827/77, 47823/78 and 109928/76, Japanese Patent Application Nos. 89128/79, 90806/79, 69488/78, 76162/78, 96445/78, 42848/79 and 96449/78, (corresponding respectively to OPI Nos. 12642/81, 16130/81, 161332/79, 4028/80, 36804/80, 13450/80 and 40402/80), Belgian Pat. No. 838,062, Japanese Patent Publication Nos. 32129/73 and 39165/73, British Pat. No. 1,542,308, *Research Disclosure,* Vol. 130, No. 13024 (February, 1975) and Vol. 176, No. 17630 (1978) and German Patent Application (OLS) No. 2,847,371.

Of the above DRR compounds, a 4-hydroxynaphthylsulfonamido compound is particularly preferred having an N-dialkyl-substituted carbamoyl group (a so-called disubstituted carbamoyl group) as a ballast group as described in U.S. Pat. No. 4,135,929.

A suitable amount of the DRR compounds is about 50 to about 0.5 moles, preferably about 20 to about 2 mols per mol of silver in the silver halide emulsion layer associated with the compound.

As the silver halide developing agent used in the present invention, any material can be used if it oxidizes the DRR compound. Particularly, black-and-white developing agents such as 3-pyrazolidinone derivatives, hydroquinones or p-aminophenols, etc., are preferred. The developing agents may be suitably used in mixtures. Particularly preferred developing agents are 3-pyrazolidinone derivatives. In greater detail, they are represented by the following formula (III):

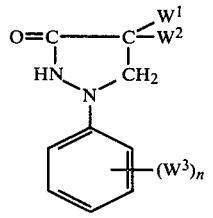

(III)

wherein $W^1$ and $W^2$, which may be the same or different, each represents a hydrogen atom, an alkyl group having 1 to about 37 carbon atoms (e.g., a methyl group, an ethyl group) or a hydroxyalkyl group having 1 to about 37 carbon atoms (e.g., hydroxymethyl, hydroxyethyl, etc.); $W^3$ represents a hydrogen atom, an alkyl group having 1 to about 6 carbon atoms (e.g., methyl, ethyl, etc.), an alkoxy group having 1 to about 20 carbon atoms (e.g., methoxy, ethoxy, etc.), a hydroxy group, an amino group including substituted amino groups having 1 to about 36 carbon atoms such as mono- or di-alkylamino groups, arylamino groups and amino groups substituted with an alkyl group or an aryl group, a aryl group preferably having 6 to 12 carbon atoms (e.g., phenyl, etc.) or a halogen atom (e.g., Cl, etc.), and n is an integer of 1 to 5; when n is 2, a suitable example for $W^3$ is a methyl group. Of the groups shown for $W^3$, groups having a negative Hammett's sigma constant are preferred.

Of these 3-pyrazolidinone compounds, compounds having a polarographic half wave potential of about −80 mV to about −200 mV (based on Standard Caromel Electrode, pH=11.0), preferably −100 mV to −150 mV are particularly useful since they can provide rapid development of silver halide grains in combination with accelerated cross-oxidation with the DRR compounds and a period of time for completing image formation can thus be shortened.

Representative examples of 3-pyrazolidinone developing agents are 1-phenyl-3-pyrazolidinone, 4-methyl-1-phenyl-3-pyrazolidinone, 4,4-dimethyl-1-phenyl-3-pyrazolidinone, 4-hydroxymethyl-4-methyl-1-phenyl-3-pyrazolidinone, 4,4-bis(hydroxymethyl)-1-phenyl-3-pyrazolidinone, 1-(4-chlorophenyl)-4-hydroxymethyl-4-methyl-3-pyrazolidinone, 4-hydroxymethyl-4-methyl-p-tolyl-3-pyrazolidinone, and 4-hydroxymethyl-1-(p-methoxyphenyl-4-methyl-3-pyrazolidinone.

Examples of hydroquinones include methylhydroquinone and t-butylhydroquinone, etc. Examples of p-aminophenols include N-methyl-p-aminophenol and N,N-diethyl-p-aminophenol, etc.

The developing agent may be contained in an alkaline processing composition (processing element) or may be contained in a suitable layer of the photosensitive material.

A method of obtaining color diffusion transfer images using DRR compounds are described in, for example, U.S. Pat. No. 3,931,144 and U.S. Published Patent Application TVPP No. B 351,673.

Also, as a method for obtaining color images, after the dye which has been released from the DRR compounds by conventional development is removed from photographic sensitive materials by washing, a color image can be obtained from the residual DRR compound by conventional bleaching and fixing. In this method, the use of DRR compounds represented by the formulae (F) and (G) yield positive images and DRR compounds represented by the formulae (A) to (E) yield negative image.

In case of using the inner latent image type direct reversal emulsions in the present invention, positive images can be directly obtained by carrying out a development processing in the presence of a fogging agent after imagewise exposure or by uniformly exposing to light (which may be either a high illuminance exposure such as a flash exposure less than $10^{-2}$ second or a low illuminance exposure for a long time) during the surface development processing to fog after imagewise exposure, as described in U.S. Pat. No. 2,456,953. Use of the fogging agent is preferred because the degree of fogging can be easily controlled. The fogging agent may be added to the photosensitive material or may be added to the developing solution. But it is preferred to add it to the photosensitive material. As the fogging agent, there are hydrazines described in U.S. Pat. Nos. 2,588,982 and 2,568,785, hydrazides and hydrazones described in U.S. Pat. No. 3,227,552, quaternary salts described in British Pat. No. 1,283,835, Japanese Patent Publication No. 38164/74, U.S. Pat. Nos. 3,734,738, 3,719,494 and 3,615,615, and acylhydrazinophenylthiourea compounds described in German Patent Application (OLS) No. 2,635,316.

The amount of the fogging agent used can vary over a wide range as occasion demands. In the case of adding it to the photosensitive material, the fogging agent is generally used in the range of about 0.1 mg to 1,500 mg (preferably 0.5 mg to 700 mg) per mol of silver halide. In the case of adding the fogging agent to the developing solution, it it used in the range of about 0.05 to 5 g (preferably 0.1 to 1 g) per liter of the developing solution. In the case of incorporating the fogging agent in any layer of the photosensitive material, it is effective to make the fogging agent non-diffusible in order to attain the objects of the present invention. As means for giving it a non-diffusible property, it is effective to bond ballast group conventionally used in color image donative substances to the fogging agent.

The photosensitive materials used in the present invention have a base which does not undergo dimensional changes. Examples of such bases include cellulose acetate films, polystyrene films, polyethylene terephthalate films and polycarbonate films, which have been generally used for photographic sensitive materials. Other effective bases include, for example, paper and paper laminated with a water-impermeable polymer such as polyethylene, etc.

The processing composition used for photographic processing of the photosensitive materials for color diffusion transfer process of the present invention is a liquid composition containing processing components necessary to develop the silver halide emulsion and to form diffusion transfer images, wherein the primary solvents are water and hydrophilic solvents such as methanol or methyl cellosolve may be contained. The processing composition contains an alkali in an amount sufficient to maintain the development pH of the silver halide emulsion layer and to neutralize acids formed during development and dye image formation (for example, hydrohalogenic acids such as hydrobromic acid or carboxylic acids such as acetic acid, etc.). As the alkali, alkali metal salts, alkaline earth metal salts and amines, such as lithium hydroxide, sodium hydroxide, potassium hydroxide, calcium hydroxide, tetramethyl ammonium hydroxide, sodium carbonate, 3 sodium phosphate and diethylamine, etc., are used.

The processing composition preferably has the pH of about 10 or more at a room temperature. It is particularly preferred to contain alkali hydroxide in a concentration so that the pH is 12 or more. It is further preferred that the processing composition contains a hydrophilic polymer such as high molecular weight polyvinyl alcohol, hydroxyethyl cellulose or sodium carboxymethyl cellulose. These polymers not only give the viscosity of 1 poise or more, preferably several hundreds (500 to 600) to 1,000 poises, at a room temperature to the processing composition to facilitate uniform spreading of the composition at processing, but also form a non-fluid film when the processing composition is condensed by movement of the aqueous solvent to the photosensitive element and the image-receiving element during the processing step to help unification of the film unit after processing. After substantial conclusion of the diffusion transfer dye image formation, this polymer film can be used to prevent migration of the coloring components into the image-receiving layer to prevent deterioration of the image.

The processing composition sometimes advantageously contains light absorbing substances such as titanium dioxide, carbon black or a pH indicating dye or desensitizers described in U.S. Pat. No. 3,579,333 in order to prevent fogging of the silver halide emulsion by outside rays during the processing. Further, the processing composition may contain a development restrainer such as benzotriazole.

It is preferred that the above-described processing composition is used by containing it in a rupturable container as described in U.S. Pat. Nos. 2,543,181, 2,643,886, 2,653,732, 2,723,051, 3,056,491, 3,056,492 and 3,152,515.

In case that the photographic sensitive material of the present invention is a photographic film unit, namely, the film unit which is processed by passing through a pair or pressing members placed in parallel, it is preferred to comprise the following elements:

(1) Photosensitive element (at least one of the direct reversal silver halide emulsion layer combined with the DRR compound and the DRR compound-containing layer contains at least one compound represented by the above-described general formula (I) in an amount of 5 to 2,000 mg based on 100 millimols of the whole silver content).

(2) Image-receiving element containing a polymer mordanting agent.

(3) Processing element which contains a means for discharging an alkaline processing composition in the film unit, such as a rupturable container, and a 3-pyrazolidinone developing agent.

(4) Base.

The photosensitive element in the above-described film unit is put on the image-receiving element so as to be in face-to-face relation. After, it is exposed to light, and processed by spreading the alkaline processing composition between both elements. In this case, the image-receiving element may be separated after transfer of the dye image, or the dye image may be viewed without separating the image-receiving element, as described in U.S. Pat. No. 3,415,645.

In another example, the image-receiving layer in the above-described film unit may be disposed so as to be unified with the base and the photosensitive element. For example, as described in Belgian Pat. No. 757,960, it is effective that the image-receiving layer, a substantially opaque light reflective layer (for example, a titanium dioxide layer and a carbon black layer) and the photosensitive element comprising a single or plural photosensitive layers are applied to a transparent base. After exposed the photosensitive element to light, an opaque cover sheet is put thereon so as to face each other and the processing composition is spread between them.

A further embodiment of the superposed unification type ones suitable for the present invention has been described in Belgian Pat. No. 757,959. According to this embodiment, the image-receiving layer, a substantially opaque liquid reflective layer (for example, those described in the above) and the photosensitive element comprising a single or plural photosensitive layers are applied to a transparent base, and a transparent cover sheet (which is preferred to contain an alkali neutralization system) is superposed thereon so as to face each other. A rupturable container filled with an alkaline processing composition containing a light intercepting agent (for example, carbon black) is disposed so as to be adjacent to the top layer of the above-described photosensitive layer and to the transparent cover sheet. This film unit is exposed to light through the transparent cover sheet and the container is then ruptured by pressing members when the film unit is taken from the camera, by which the processing composition (containing the clouding agent) is spread between the photosensitive layer and the cover sheet. Thus the film unit is intercepted from light and the development advances.

Other unified type film units suitable for the present invention have been described in U.S. Pat. Nos. 3,415,644, 3,415,645, 3,415,646, 3,647,487 and 3,635,707 and German Patent Application (OLS) No. 2,426,980.

The term "associated with" as used herein is intended to mean that the materials can be in either the same or different layers as long as the materials are accessible to one another.

The present invention will be further illustrated with reference to the following examples.

EXAMPLE 1

The following layers were applied in turn to a transparent polyester base to produce a photosensitive sheet.

(1) A mordanting layer containing the following mordanting agent (3.0 g/m$^2$) and gelatin (3.0 g/m$^2$).

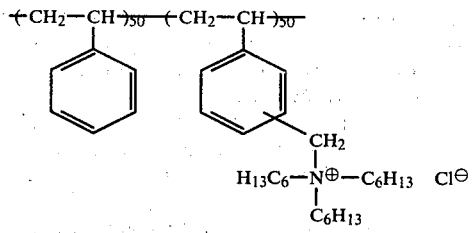

(2) A white reflective layer containing titanium dioxide (20 g/m$^2$) and gelatin (2.0 g/m$^2$).

(3) A light intercepting layer containing carbon black (2.70 g/m$^2$) and gelatin (2.70 g/m$^2$).

(4) A layer containing the following cyan DRR compound (0.53 g/m$^2$), diethyl laurylamide (0.15 g/m$^2$), 2,5-di-t-octylhydroquinone (0.011 g/m$^2$) and gelatin (1.30 g/m$^2$).

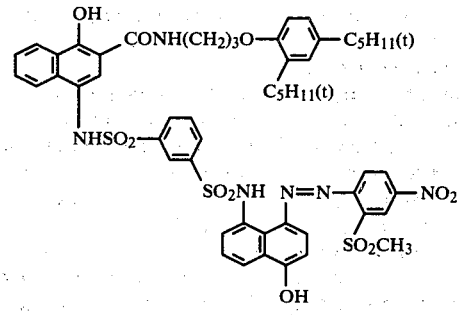

(5) A layer containing a red-sensitive inner latent image type direct reversal silver bromide emulsion (silver content: 2.14 g/m$^2$), gelatin (2.56 g/m$^2$), the following fogging agent (0.11 mg/m$^2$) and sodium pentadecylhydroquinone,

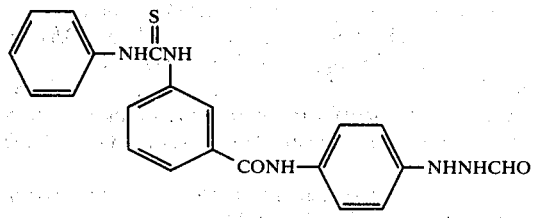

sulfonate (0.26 g/m$^2$).

(6) A layer containing gelatin (1.91 g/m$^2$) and 2,5-dipentadecylhydroquinone (0.88 g/m$^2$).

(7) A layer containing the following magenta DRR compound (0.62 g/m$^2$), diethyl laurylamide (0.14 g/m$^2$), 2,5-di-t-octylhydroquinone (0.016 g/m$^2$) and gelatin (1.05 g/m$^2$).

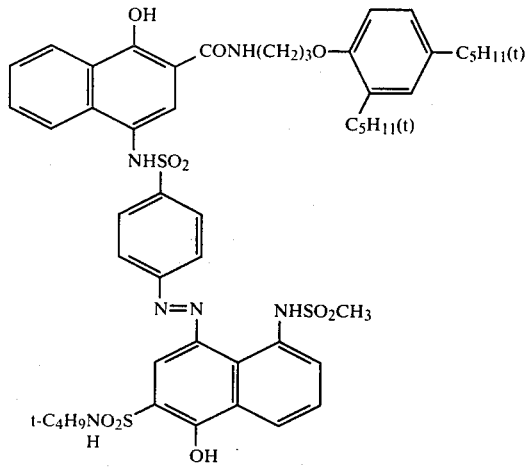

(8) A layer containing a green-sensitive inner latent image type direct reversal silver bromide emulsion (silver content: 1.51 g/m$^2$), gelatin (1.68 g/m$^2$), the same fogging agent as that added to the layer (5) (0.07 mg/m$^2$) and sodium pentadecylhydroquinone sulfonate (0.14 g/m$^2$).

(9) A layer containing gelatin (1.87 g/m$^2$) and 2,5-dipentadecylhydroquinone (1.30 g/m$^2$).

(10) A layer containing the following yellow DRR compound (1.21 g/m$^2$), diethyl laurylamide (0.05 g/m$^2$), 2,5-di-t-octylhydroquinone (0.029 g/m$^2$) and gelatin (1.28 g/m$^2$).

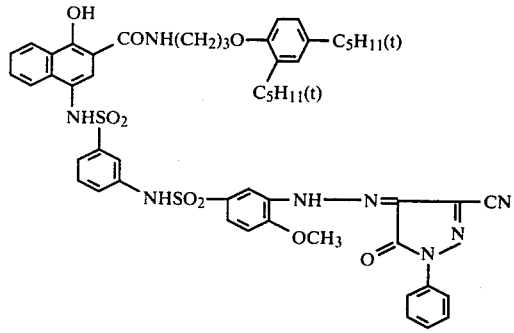

(11) A layer containing a blue-sensitive inner latent image type direct reversal silver bromide emulsion (silver content: 2.55 g/m$^2$), gelatin (2.63 g/m$^2$), the same fogging agent as that added to the layer (5) (0.13 mg/m$^2$) and sodium pentadecylhydroquinone sulfonate (0.16 g/m$^2$).

(12) A layer containing gelatin (1.05 g/m$^2$).

A rupturable container was filled with 0.8 g of a processing solution having the following composition.

| Processing Solution | |
|---|---|
| 1-Phenyl-4-hydroxymethyl-4-methyl-3-pyrazolidinone | 13 g |
| Methylhydroquinone | 0.18 g |
| 5-Methylbenzotriazole | 4.0 g |
| Sodium Sulfite (anhydrous) | 1.0 g |
| Na Salt of Carboxymethyl Cellulose | 47.0 g |
| Carbon Black | 150 g |
| Potassium Hydroxide (28% aq. soln.) | 200 cc |
| $H_2O$ | 550 cc |

A cover sheet was produced by applying the following layers in turn to a transparent polyester base.

(1) A layer containing an acrylic acid-butyl acrylate copolymer (80:20 by weight) (22 g/m$^2$) and 1,4-bis(2,3-epoxypropoxy)butane (0.44 g/m$^2$).

(2) A layer containing acetyl cellulose (100 g of acetyl cellulose was hydrolyzed to form 39.4 g of acetyl group) (3.8 g/m$^2$), a styrene-maleic acid anhydride copolymer (60:40 by weight) (molecular weight: about 50,000) (0.2 g/m$^2$) and 5-($\beta$-cyanoethylthio)-1-phenyltetrazole (0.115 g/m$^2$).

(3) A layer containing a vinylidene chloride-methyl acrylate-acrylic acid copolymer (85:12:3 by weight) latex (2.5 g/m$^2$) and a polymethyl methacrylate (particle size: 1 to 3 microns) (0.05 g/m$^2$).

Samples A to C in which 40 mg/m$^2$ of each compound shown in Table 1 was added to the layer (4) of the above-described photosensitive sheet and Sample E in which no compound was added were prepared. After exposure to light, they were unified with the above-described processing solution and the cover sheet, and the processing solution was then spread by means of pressing members at 25° C. to obtain a transfer color image.

Further, for comparison, Sample D in which the same compound as that of Sample C was added to the middle layer as described in *Research Disclosure*, No. 1516 (Nov., 1976) was processed similarly.

For further comparison, Sample F in which phenyl tetrazolylthio-substituted hydroquinone (having neither alkylthio nor arylthio) falling within the general formula described in U.S. Pat. No. 3,379,529 issued to Porter et al was processed similarly.

Results obtained are shown in Table 1 below

TABLE 1

Compound Used and Transfer Color Image Density

| Sample | Compound | Layer | Cyan Density $D_{max}$ | Cyan Density $D_{min}$ | Note |
|---|---|---|---|---|---|
| A | 2-n-Dodecylthio-6-(1'-phenyl-tetrazole-5'-ylthio)-hydroquinone | DRR layer (4) | 1.74 | 0.29 | Invention |
| B | 2-n-Hexadecylthio-5-(1'-phenyl-tetrazole-5'-ylthio)-hydroquinone | DRR layer (4) | 1.81 | 0.29 | " |
| C | 2-n-Octadecylthio-5-(1'-phenyl-tetrazole-5'-ylthio)-hydroquinone | DRR layer (4) | 1.78 | 0.30 | " |
| D | The same compound as that of | Intermediate (6) | 1.87 | 0.36 | Comparison |

TABLE 1-continued

| Compound Used and Transfer Color Image Density | | | | | |
|---|---|---|---|---|---|
| | | | Cyan Density | | |
| Sample | Compound | Layer | $D_{max}$ | $D_{min}$ | Note |
| | Sample B | | | | |
| E | None | Intermediate (6) | 1.88 | 0.37 | " |
| F | 2-t-Octyl-5-(1'-phenyltetrazole-5'-ylthio)hydroquinone | DRR layer (4) | 1.52 | 0.29 | " |

As is understood from Table 1, Samples A to C in which each compound shown in Table 1 was added to the dye image-forming layer (4) gave a low minimum density. The Samples A to C gave good gradation having good cutting at the foot part, and stains hardly occur even under forced deterioration conditions at 50° C. and 80% RH for 3 days. On the other hand, results in Sample D in which the compound was added to the intermediate layer (6) were different from those in Sample E in which no compound was added, and gradation thereof was not improved. Further when compared to Sample F, its Dmax was inferior to Samples A to C, though its Dmin was comparable to the system of this invention.

EXAMPLE 2

The same procedure as in Example 1 was carried out except that Compound (B) was added to the layer (4) of the photosensitive sheet in an amont of 40 mg/m$^2$ or to the layer (7) in an amount of 30 mg/m$^2$. As the result, a high maximum density of magenta or cyan was maintained, while a low minimum density and good gradation having good curing at the foot part were obtained.

EXAMPLE 3

The same procedure as in Example 1 was carried out except that Compound (D) was added to the layer (5) of the photosensitive sheet in an amount of 30 mg/m$^2$ or to the layer (8) in an amount of 40 mg/m$^2$. As the result, a high maximum density of magenta or cyan was maintained, while a low minimum density and good gradation having good cutting at the foot part and a good straight property were obtained.

EXAMPLE 4

Samples G to J in which $8\times10^{-5}$ mols/m$^2$ of each compound shown in Table 2 was added to the layer (4) of the photosensitive sheet in Example 1 were produced. They were processed at 25° C. and 35° C. by the same manner as in Example 1. Results obtained were shown in Table 2. It is apparent from Table 2 that Compounds (G) and (H) (for comparison) gave a high minimum density. Further, the compounds (G) and (H) gave gradation in which cutting at the foot part was inferior. On the other hand, the Compunds (I) and (J) (in the present invention) gave a low minimum density and good gradation having good cutting at the foot part.

TABLE 2

| | | Cyan Density | | | | |
|---|---|---|---|---|---|---|
| | | 25° C. | | 35° C. | | |
| Sample | Compound | $D_{max}$ | $D_{min}$ | $D_{max}$ | $D_{min}$ | Note |
| G | 1-Phenyl-5-mercaptotetrazole | 1.60 | 0.48 | — | — | Comparison |
| H | 2-n-Dodecylthiohydroquinone | 1.84 | 0.33 | 1.97 | 0.68 | " |
| I | 2-n-Dodecylthio-6-(1'-phenyltetrazole-5'-ylthio)hydroquinone | 1.74 | 0.30 | 1.81 | 0.34 | Invention |
| J | 2-n-Octadecylthio-5-(1'-phenyltetrazole-5'-ylthio)hydroquinone | 1.74 | 0.30 | 1.82 | 0.34 | " |

EXAMPLE 5

The following layers were applied in turn to a transparent polyester base to produce a photosensitive sheet.

(1) The same layer as the layer (1) of Example 1.

(2) The same layer as the layer (2) of Example 1.

(3) The same layer as the layer (3) of Example 1.

(4) A layer containing the following cyan DRR compound (0.40 g/m$^2$), tricyclohexylphosphate (0.09 g/m$^2$), 2,5-di-t-pentadecylhydroquinone (0.01 g/m$^2$) and gelatin (0.8 g/m$^2$).

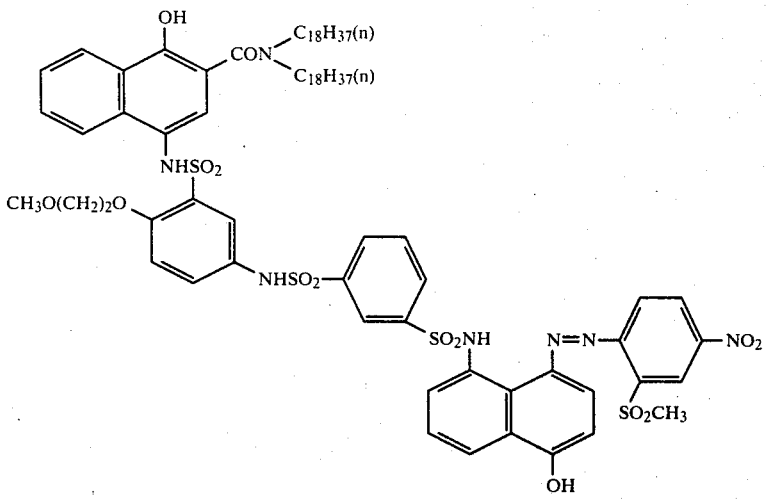

(5) A layer containing a red-sensitive inner latent image type direct reversal silver bromide emulsion (silver content: 1.03 g/m$^2$), gelatin (1.2 g/m$^2$), the same fogging agent as that added to the layer (5) of Example 1 (0.05 mg/m$^2$) and sodium pentadecylhydrosulfonate (0.13 g/m$^2$).

(6) A layer containing gelatin (0.6 g/m$^2$), 2,5-di-t-pentadecylhydroquinone (0.71 g/m$^2$) and a copolymer of vinyl pyrrolidone and vinyl acetate (0.24 g/m$^2$) (mole ratio: 7:3).

(7) A layer containing gelatin (0.4 g/m$^2$).

(8) A layer containing magenta DRR compound of the following formula [I] (0.21 g/m$^2$), magenta DRR compound of the following formula [II] (0.11 g/m$^2$), tricyclohexylphosphate (0.08 g/m$^2$), 2,5-di-t-pentadecylhydroquinone (0.01 g/m$^2$) and gelatin (0.6 g/m$^2$).

[I]

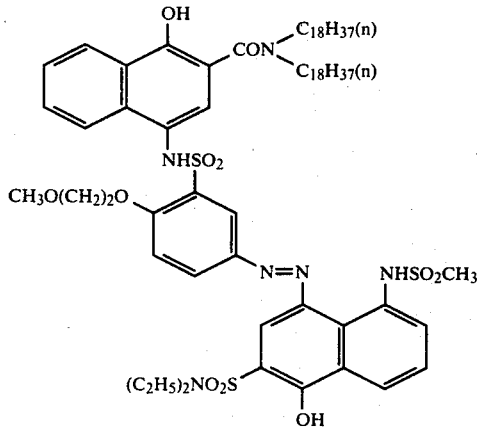

-continued

[II]

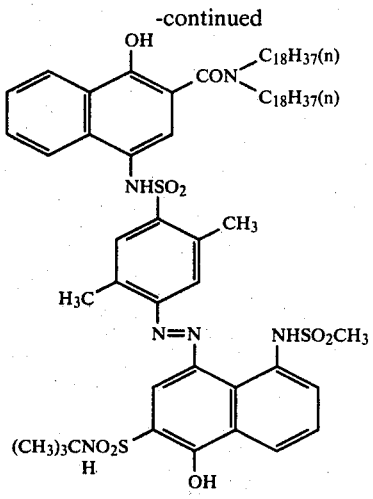

(9) A layer containing a green-sensitive inner latent image type direct reversal silver bromide emulsion (silver content: 0.82 g/m$^2$), gelatin (0.9 g/m$^2$), the same fogging agent as that added to the layer (5) (0.03 mg/m$^2$) and sodium pentadecylhydroquinone sulfonate (0.08 g/m$^2$).

(10) A layer containing gelatin (0.6 g/m$^2$), 2,5-di-t-pentadecylhydroquinone (0.71 g/m$^2$) and a copolymer of vinyl pyrrolidone and vinyl acetate (0.24 g/m$^2$) (mole ratio: 7:3).

(11) A layer containing gelatin (0.4 g/m$^2$).

(12) A layer containing the following yellow DRR compound (0.53 g/m$^2$), tricyclohexylphosphate (0.13 g/m$^2$), 2,5-di-t-pentadecylhydroquinone (0.01 g/m$^2$) and gelatin (0.7 g/m$^2$).

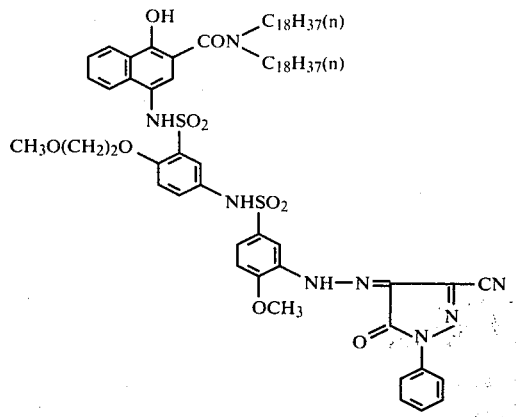

(13) A layer containing a blue-sensitive inner latent image type direct reversal silver bromide emulsion (silver content: 1.09 g/m$^2$), gelatin (1.1 g/m$^2$), the same fogging agent as that added to the layer (5) (0.04 mg/m$^2$) and sodium pentadecylhydroquinone sulfate (0.07 g/m$^2$).

(14) A layer containing gelatin (1.0 g/m$^2$).

The photosensitive sheet described above shall be regarded as Sample K.

Sample L in which 40 mg/m$^2$ of 2-n-hexadecylthio-5-(1-phenyltetrazole-5-ylthio)hydroquinone in the layer (4) and 30 mg/m$^2$ of that in the layer (8) was added was prepared. After exposure to light, Samples K and L were unified with the processing solution of Example 1 and cover sheet, and the processing solution was then spread by means of pressing members at a thickness of 80 $\mu$m, at a temperature of 15° C., 25° C. and 35° C. to obtain a transfer color image. Results obtained are shown in Table 3.

As will be understood from Table 3, a low minimum density and good gradation having good cutting at the foot part were obtained in Sample L as compared with that in Sample K.

TABLE 3

| Sample | Temperature (°C.) | $D_{max}$* Cyan | $D_{max}$* Magneta | $D_{max}$* Yellow | $D_{min}$* Cyan | $D_{min}$* Magneta | $D_{min}$* Yellow | Gradation at** the Foot Part Cyan | Gradation at** the Foot Part Magneta | Gradation at** the Foot Part Yellow |
|---|---|---|---|---|---|---|---|---|---|---|
| K | 15 | 1.95 | 2.16 | 1.74 | 0.38 | 0.22 | 0.20 | 0.03 | 0.03 | 0.05 |
| | 25 | 1.97 | 2.12 | 1.73 | 0.40 | 0.23 | 0.20 | 0.03 | 0.05 | 0.18 |
| | 35 | 2.00 | 2.20 | 1.83 | 0.44 | 0.27 | 0.23 | 0.03 | 0.10 | 0.18 |
| L | 15 | 1.88 | 2.27 | 1.88 | 0.33 | 0.18 | 0.18 | 0.06 | 0.06 | 0.17 |
| | 25 | 1.92 | 2.14 | 1.78 | 0.33 | 0.19 | 0.18 | 0.10 | 0.13 | 0.19 |
| | 35 | 1.91 | 2.12 | 1.78 | 0.37 | 0.22 | 0.19 | 0.16 | 0.14 | 0.17 |

*Reflection density

**Defined as ΔD which is a value measured from a point A to a point B. The point A is on a horizontal line defined by $D_{min}$ + 0.05 being shifted −0.2 from the contact point of the horizontal line on the characteristic curve. The point B is defined by a contact point on the characteristic curve with a line perpendicular to the horizontal line passing through the point A.

While the invention has been described in detail and with reference to specific embodiments thereof, it will be apparent to one skilled in the art that various changes and modifications can be made therein without departing from the spirit and scope thereof.

What is claimed is:

1. In a color photographic sensitive material comprising at least one direct reversal silver halide emulsion layer associated with a diffusible dye-releasing redox compound on a support, the improvement which comprises that at least one of (1) a layer containing said redox compound, said layer containing said redox compound being adjacent said silver halide emulsion layer, (2) said direct reversal silver halide emulsion layer and (3) said direct reversal silver halide emulsion layer containing said redox compound contains about 5 to 2000 mg per 100 millimols silver in the emulsion layer of a compound represented by the general formula (I):

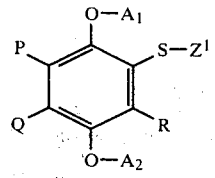

(I)

wherein $A_1$ and $A_2$ each represents a hydrogen atom or a hydrolyzable group, P, Q and R which may be the same or different each represents a hydrogen atom, an alkyl group, an aryl group, an alkylthio group, an arylthio group, a hydroxyl group, a halogen atom, an alkoxy group, an aryloxy group, a heterocyclic group or an —S—$Z^2$ group, where at least one of P and Q is an alkylthio group or an aryl thio group and at least one of P, Q and R contains a ballast group; $Z^1$ and $Z^2$ which may be the same or different each represents an unsaturated heterocyclic residue which is photographically inactive when bonded to the hydroquinone moiety through the sulfur atom, and —S—$Z^1$ or —S—$Z^2$ is an atomic group which is released upon oxidation to exhibit a development inhibiting function.

2. The photosensitive material of claim 1, wherein $A_1$, $A_2$, P and R represent a hydrogen atom, Q represents an alkylthio group having 1 to 20 carbon atoms and Z represents a tetrazolyl group.

3. The photosensitive material of claim 1, wherein $A_1$, $A_2$, Q and R each represents a hydrogen atom, P represents an alkylthio group containing 1 to 20 carbon atoms and Z represents a tetrazolyl group.

4. The photosensitive material of claim 1, wherein $A_1$, $A_2$ and R each represents a hydrogen atom, P represents a tetrazolylthio group, Q represents an alkylthio group having 1 to 20 carbon atoms and Z represents a tetrazolyl group.

5. The photosensitive material of claim 1, wherein said compound of the formula (I) is present in an amount of about 20 to 500 mg per 100 millimols silver in the silver halide emulsion layer.

6. The photosensitive material of claim 1, wherein said silver halide is an inner latent image type silver halide.

7. The photosensitive material of claim 6, wherein at least one layer of said material contains a fogging agent.

8. The photosensitive material of claim 1, wherein said silver halide is silver bromide, silver iodobromide or silver chloroiodobromide containing 10 mol% or less iodide, 30 mol% or less chloride and the balance bromide.

9. The photosensitive material of claim 1, wherein said diffusible dye-releasing redox compound is represented by the formula (II):

$$Y\text{-}D \qquad \text{(II)}$$

wherein D represents a diffusible dye or a precursor thereof and Y represents a group which releases the dye D upon development in an alkaline environment.

10. The photosensitive material of claim 9, wherein Y is represented by the formula (A):

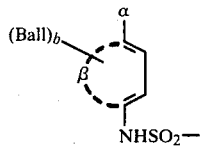

(A)

wherein $\beta$ represents the non-metallic atoms necessary to complete a benzene ring which may be condensed with a carbocyclic or a heterocyclic ring and which may be substituted and $\alpha$ represents an $—OG^1$ or $—NHG^2$ group where $G^1$ represents a hydrogen atom or a group which forms a hydroxyl group upon hydrolysis, and $G^2$ represents a hydrogen atom, a hydrolyzable group or an alkyl group having 1 to 22 carbon atoms, Ball represents a ballast group and b is 1 or 2 when $\alpha$ represents a group represented by $—OG^1$ or $—NHG^2$ wherein $G^2$ represents a hydrogen atom, an alkyl group having 1 to 8 carbon atoms or a hydrolyzable group and b represents 0 or 1 when $\alpha$ represents $—NHG^2$ wherein $G^2$ represents an alkyl group having 9 to 22 carbon atoms and making the compound of the general formula (A) immobile and non-diffusible.

11. The photosensitive material of claim 9, wherein Y represents a group represented by the formula (B):

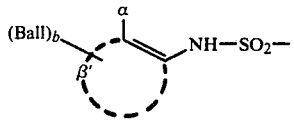

(B)

where B' represents the non-metallic atoms necessary to complete a carbocyclic ring which may be condensed with a carbocyclic or heterocyclic ring and may be substituted; $\alpha$ represents an $—OG^1$ group or an $—NHG^2$ group wherein $G^1$ represents a hydrogen atom or a hydrolyzable group and $G^2$ represents a hydrogen atom, a hydrolyzable group or an alkyl group having 1 to 22 carbon atoms, b is 1 or 2 when $\alpha$ represents a group represented by $—OG^1$ or $—NHG^2$ wherein $G^2$ represents a hydrogen atom, an alkyl group having 1 to 8 carbon atoms or a hydrolyzable group and b represents 0 or 1 when $\alpha$ represents $—NHG^2$ wherein $G^2$ represents an alkyl group having 9 to 22 carbon atoms and making the compound of the general formula (A) immobile and non-diffusible and Ball represents a ballast group.

12. The photosensitive material of claim 9, wherein Y represents a group of the formula (C):

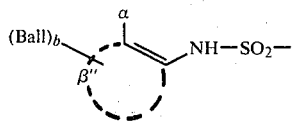

(C)

wherein $\beta''$ represents the non-metallic atoms necessary to form a heterocyclic ring which may be further condensed with a carbocyclic ring or a heterocyclic ring which rings may be substituted, $\alpha$ represents an $—OG^1$ or an $—NHG^2$ group where $G^1$ represents a hydrogen atom or a hydrolyzable group and $G^2$ represents a hydrogen atom, a hydrolyzable group or an alkyl group having 1 to 22 carbon atoms, b represents 1 or 2 when $\alpha$ represents a group represented by $—OG^1$ or $—NHG^2$ wherein $G^2$ represents a hydrogen atom, an alkyl group having 1 to 8 carbon atoms or a hydrolyzable group and b represents 0 or 1 when $\alpha$ represents $—NHG^2$ wherein $G^2$ represents an alkyl group having 9 to 22 carbon atoms and making the compound of the general formula (A immobile and non-diffusible and Ball represents a ballast group.

13. The photosensitive material of claim 9, wherein Y is represented by a group of the formula (D):

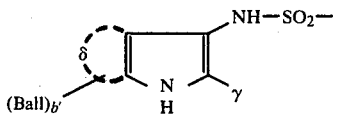

(D)

wherein Ball represents a ballast group, $\gamma$ represents a hydrogen atom, a substituted or unsubstituted alkyl, aryl or heterocyclic group or a $—CO—G^6$ group wherein $G^6$ represents $—OG^7$, $—SG^7—$ or $—NG^8G^9$ where $G^7$ represents a hydrogen atom, an alkyl group, a cycloalkyl group or an aryl group which may be substituted, $G^8$ has the same definition as $G^7$ or is an acyl group and $G^9$ represents a hydrogen atom or a substituted or unsubstituted alkyl group; $\delta$ represents the non-metallic atoms necessary to complete a condensed benzene ring which may be substituted, at least one of the substituents on a condensed benzene ring in $\gamma$ and/or on the condensed benzene ring in $\delta$ may be ballast groups or groups containing the ballast group; b' represents 0 or 1 when $\gamma$ represents a group having more than 8 carbon atoms and b' represents 1 or 2 when $\gamma$ represents a group having 1 to 8 carbon atoms.

14. The photosensitive material of claim 9, wherein Y is represented by the formula (E):

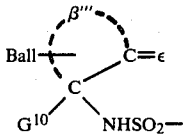

(E)

wherein Ball represents a ballast group, $\epsilon$ represents an oxygen atom or an $=NG''$ group wherein G'' represents a hydroxyl group or an amino group which may be substituted, $\beta''$ represents a 5- to 7-membered saturated or unsaturated non-aromatic carbocyclic ring which may be condensed with an aromatic, alicyclic or heterocyclic ring and which may be substituted, and $G^{10}$ represents a hydrogen atom or a halogen atom.

15. A process for forming color images which comprises imagewise exposing a color photographic sensitive material comprising at least one direct reversal silver halide emulsion layer associated with a diffusible dye-releasing redox compound on a support and characterized by the presence of a compound of the formula (I):

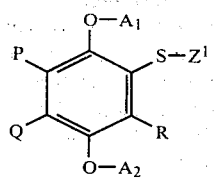

(I)

wherein $A_1$ and $A_2$ each represents a hydrogen atom or a hydrolyzable group, P, Q and R which may be the same or different each represents a hydrogen atom, an alkyl group, an aryl group, an alkylthio group, an arylthio group, a hydroxyl group, a halogen atom, an alkoxy group, an aryloxy group, a heterocyclic group or an —S—$Z^2$ group, $Z^1$ and $Z^2$ may be the same or different and each represents an unsaturated heterocyclic residue which is photographically inactive when bonded to the hydroquinone through the sulfur moiety, and —S—$Z^1$ or —S—$Z^2$ is an atomic group which when released by oxidation exhibits a, development inhibiting function; at least one of P and Q is an alkylthio group or an arylthio group, and at least one of P, Q and R contains a ballast group, in an amount of about 5 to 2000 mg per 100 millimols silver in the emulsion, in at least one of (1) a layer containing said redox compound, said layer containing said redox compound being adjacent said silver halide emulsion layer, (2) said direct reversal silver halide emulsion layer and (3) said emulsion layer containing said redox compound, and then developing thus exposed color photographic sensitive material with a black-and-white developer containing a 3-pyrazolidinone.

16. The process of claim 15 wherein said 3-pyrazolidinone is selected from the compounds represented by the formula (III):

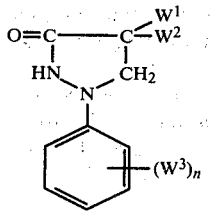

(III)

wherein $W^1$ and $W^2$, which may be the same or different, each represents a hydrogen atom, an alkyl group or a hydroxyalkyl group, $W^3$ represents a hydrogen atom, an alkyl group, an alkoxy group, a hydroxy group, a substituted or unsubstituted amino group or an aryl group, and n is an integer of 1 to 5.

17. The process of claim 16, wherein said 3-pyrazolidinone possesses a polarographic half wave potential of about −80 mV to about −200 mV (based on Standard Caromel Electrode, pH=11.0).

18. The process of claim 15, wherein $A_1$, $A_2$, P and R represents a hydrogen atom, Q represents an alkylthio group having 1 to 20 carbon atoms and Z represents a tetrazolyl group.

19. The process of claim 15, wherein $A_1$, $A_2$, Q and R each represents a hydrogen atom, P represents an alkylthio group containing 1 to 20 carbon atoms and Z represents an tetrazolyl group.

20. The process of claim 15, wherein $A_1$, $A_2$ and R each represents a hydrogen atom, P represents a tetrazolylthio group, Q represents an alkylthio group having 1 to 20 carbon atoms and Z represents a tetrazolyl group.

21. The process of claim 15, wherein said compound of the formula (I) is present in an amount of about 20 to 500 mg per 100 millimols silver in the silver halide emulsion layer.

22. The process of claim 15, wherein said silver halide is an inner latent image type silver halide.

23. The process of claim 15, wherein at least one layer of said material contains a fogging agent.

24. The process of claim 15, wherein said silver halide is silver bromide, silver iodobromide or silver chloroiodobromide containing 10 mol% or less iodide, 30 mol% or less chloride and the balance bromide.

25. The process of claim 15, wherein said diffusible dye-releasing redox compound is represented by the formula (II):

Y—D (II)

wherein D represents a diffusible dye or a precursor thereof and Y represents a group which releases the dye D upon development in an alkaline environment.

26. The process of claim 25, wherein Y is represented by the formula (A):

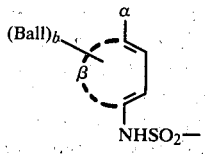

(A)

wherein β represents the non-metallic atoms necessary to complete a benzene ring which may be condensed with a carbocyclic or a heterocyclic ring and which may be substituted and α represents an —$OG^1$ or —$NHG^2$ group where $G^1$ represents a hydrogen atom or a group which forms a hydroxyl group upon hydrolysis, and $G^2$ represents a hydrogen atom, a hydrolyzable group or an alkyl group having 1 to 22 carbon atoms, Ball represents a ballast group and b is 1 or 2 when α represents a group represented by —$OG^1$ or —$NHG^2$ wherein $G^2$ represents a hydrogen atom, an alkyl group having 1 to 8 carbon atoms or a hydrolyzable group and b represents 0 or 1 when α represents —$NHG^2$ wherein $G^2$ represents an alkyl group having 9 to 22 carbon atoms and making the compound of the general formula (A) immobile and non-diffusible.

27. The process of claim 25, wherein Y represents a group represented by the formula (B):

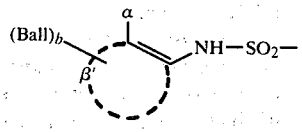

(B)

where β' represents the non-metallic atoms necessary to complete a carboxylic ring which may be condensed with a carbocyclic or heterocyclic ring and may be substituted; $\alpha$ represents an $—OG^1$ group or an $—NHG^2$ group wherein $G^1$ represents a hydrogen atom or a hydrolyzable group and $G^2$ represents a hydrogen atom, a hydrolyzable group or an alkyl group having 1 to 22 carbon atoms, b is 1 or 2 when $\alpha$ represents a group represented by $—OG^1$ or $—NHG^2$ wherein $G^2$ represents a hydrogen atom, an alkyl group having 1 to 8 carbon atoms or a hydrolyzable group and b represents 0 or 1 when $\alpha$ represents $—NHG^2$ wherein $G^2$ represents an alkyl group having 9 to 22 carbon atoms and making the compound of the general formula (A) immobile and non-diffusible and Ball represents a ballast group.

28. The process of claim 25, wherein Y represents a group represented by the formula (C):

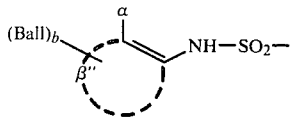

(C)

wherein $\beta''$ represents the non-metallic atoms necessary to form a heterocyclic ring which may be further condensed with a carbocyclic ring or a heterocyclic ring which rings may be substituted, $\alpha$ represents an $—OG^1$ or an $—NHG^2$ group where $G^1$ represents a hydrogen atom or a hydrolyzable group and $G^2$ represents a hydrogen atom, a hydrolyzable group or an alkyl group having 1 to 22 carbon atoms, b represents 1 or 2 when $\alpha$ represents a group represented by $—OG^1$ or $—NHG^2$ wherein $G^2$ represents a hydrogen atom, an alkyl group having 1 to 8 carbon atoms or a hydrolyzable group and b represents 0 or 1 when $\alpha$ represents $—NHG^2$ wherein $G^2$ represents an alkyl group having 9 to 22 carbon atoms and making the compound of the general formula (A) immobile and non-diffusible and Ball represents a ballast group.

29. The process of claim 25, wherein Y represented by a group of the formula (D):

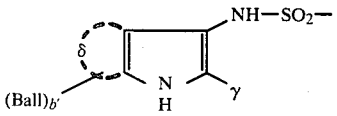

(D)

wherein Ball represents a ballast group, $\gamma$ represents a hydrogen atom, a substituted or unsubstituted alkyl, aryl or heterocyclic group or a $—CO—G^6$ group wherein $G^6$ represents $—OG^7$, $—SG^7—$ or $—NG^8G^9$ where $G^7$ represents a hydrogen atom, an alkyl group, a cycloalkyl group or an aryl group which may be substituted, $G^8$ has the same definition as $G^7$ or is an acyl group and $G^9$ represents a hydrogen atom or a substituted or unsubstituted alkyl group, $\delta$ represents the non-metallic atoms necessary to complete a condensed benzene ring which may be substituted, at least one of the substituents on a condensed benzene ring in $\gamma$ and/or on the condensed benzene ring in $\gamma$ may be ballast groups or groups containing the ballast group; b' represents 0 or 1 when $\gamma$ represents a group having more than 8 carbon atoms and b' represents 1 or 2 wherein $\gamma$ represents a group having 1 to 8 carbon atoms.

30. The process of claim 25, wherein Y is represented by the formula (E):

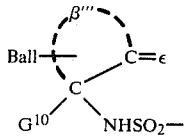

(E)

wherein Ball represents a ballast group, $\epsilon$ represents an oxygen atom or an $=NG''$ group wherein $G''$ represents a hydroxyl group or an amino group which may be substituted, $\beta'''$ represents a 5- or 7-membered saturated or unsaturated non-aromatic carbocyclic ring which may be condensed with an aromatic, alicyclic or heterocyclic ring and which may be substituted, and $G^{10}$ represents a hydrogen atom or a halogen atom.

31. The process of claim 15, wherein development is carried out at a pH of 10 or more.

32. The process of claim 15, wherein said developing agent is contained in a rupturable container associated with said photosensitive material in such a manner that upon rupturing said container a processing composition containing the developing agent is spread uniformly over the surface of said photosensitive material.

33. The process of claim 32, wherein said processing composition contains a light absorbing substance.

34. The photosensitive material of claim 1, wherein said photosensitive material is a color diffusion transfer process photosensitive material.

35. The photosensitive material of claim 9, wherein Y is represented by the formula (II-b):

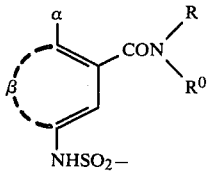

(II-b)

wherein $\beta$ represents the non-metallic atoms necessary to complete a naphthalene ring which may be substituted;

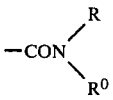

is a ballast group wherein R and $R^0$, which may be the same or different each represents an alkyl group; $\alpha$ represents an $—OG^1$ or $—NHG^2$ group where $G^1$ represents a hydrogen atom or a group which forms a hydroxyl group upon hydrolysis, and $G^2$ represents a hydrogen atom, a hydrolyzable group or an alkyl group having 1 to 22 carbon atoms.

* * * * *